US007150249B2

(12) United States Patent
Kato

(10) Patent No.: US 7,150,249 B2
(45) Date of Patent: Dec. 19, 2006

(54) LUBRICATION SYSTEM FOR TWO-CYCLE ENGINE

(75) Inventor: Masahiko Kato, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 345 days.

(21) Appl. No.: 10/439,049

(22) Filed: May 15, 2003

(65) Prior Publication Data

US 2003/0213649 A1 Nov. 20, 2003

(30) Foreign Application Priority Data

May 20, 2002 (JP) ..... 2002-144658

(51) Int. Cl.
*F01M 1/16* (2006.01)

(52) U.S. Cl. ..... 123/73 AD; 123/196 R

(58) Field of Classification Search ..... 123/196 R, 123/73 AD

See application file for complete search history.

(56) References Cited

U.S. PATENT DOCUMENTS 4,726,330 A * 2/1988 Shiga ..... 123/73 AD
4,967,700 A 11/1990 Torigai
4,989,555 A * 2/1991 Matsuo et al. ..... 123/73 AD
5,062,399 A 11/1991 Nagakura et al.
5,067,454 A * 11/1991 Waddington et al. .... 123/196 S
5,287,833 A 2/1994 Yashiro
5,353,759 A 10/1994 Abe et al.
5,355,851 A 10/1994 Kamiya
5,370,089 A 12/1994 Harada
5,390,635 A 2/1995 Kidera et al.
5,511,524 A 4/1996 Kidera et al.
5,522,370 A 6/1996 Katoh et al.
5,526,783 A 6/1996 Ito et al.
5,597,051 A 1/1997 Moriya et al.
5,630,383 A 5/1997 Kidera et al.
5,787,847 A 8/1998 Ozawa et al.
5,829,401 A 11/1998 Masuda
5,934,242 A 8/1999 Anamoto
6,516,756 B1 * 2/2003 Kato et al. ..... 123/73 AD

FOREIGN PATENT DOCUMENTS

JP 10-37730 2/1998

* cited by examiner

*Primary Examiner*—Erick R Solis
(74) *Attorney, Agent, or Firm*—Knobbe, Martens, Olson & Bear, LLP

(57) ABSTRACT

An engine has a lubrication system that lubricates the engine with lubricant. The lubrication system incorporates a lubrication pump that periodically pressurizes the lubricant toward the engine. An engine speed sensor and a throttle valve position sensor are provided to sense an engine speed and a throttle valve position (i.e., engine load), respectively. A control device controls the lubrication pump. The control device determines a frequency of the periodic pressurization based upon signals from the sensors. The control device sets a pressurizing time of the lubrication pump to a period of time shorter than the maximum period of time that can be set for the lubrication pump at the determined frequency, when the signals from the sensors indicate that the engine speed is less than a preset engine speed and the engine load is less than a preset engine load.

45 Claims, 15 Drawing Sheets

Adjustment Coefficincy $K_T$ Control Map

| | | | | | | |
|---|---|---|---|---|---|---|
| $K_T$ | | $K_T1$ | | | | |
| Temperature (°C) | | t1 | | | | |

*Figure 10*

LUBRICATION SYSTEM FOR TWO-CYCLE ENGINE

PRIORITY INFORMATION

This application is based on and claims priority under 35 U.S.C. §119 to Japanese Patent Application Nos. 2002-144658, filed on May 20, 2002, the entire contents of which is hereby expressly incorporated by reference herein.

BACKGROUND OF THE INVENTION

1. Field of the Invention

The present application relates to a lubrication system for a two-cycle engine, and more particularly a lubrication system that incorporates a lubrication pump that periodically pressurizes lubricant to a portion of a two-cycle engine.

2. Description of Related Art

In all fields of engine design, there is an increasing emphasis on obtaining more effective emission control. Recent two-cycle engines, therefore, incorporate a lubricant pump to deliver a desired amount of lubricant to lubricate internal portions of the engines. Mechanically operated pumps can be used as the lubricant pump. Such mechanical pumps, however, are not easily controlled to provide highly precise amounts of lubricant in response to engine operations. Electrically operable pumps tend to replace the mechanical pumps because higher precision controls are more widely available with such electrical pumps.

The electrical pumps can periodically pressurize lubricant under control of a control device such as, for example, an electronic control unit (ECU). The ECU can control a frequency of the periodic pressurization with, for example, an electronic control signal configured to operate the pump in accordance with a desired duty cycle. The higher the frequency, the greater the amount of the lubricant.

An electromagnetic solenoid pump is one type of such electrical pump. Japanese Laid Open Patent Publication 10-37730 discloses a lubrication system incorporating such an electromagnetic solenoid pump. The solenoid pump has a pumping piston reciprocally disposed in a pump housing. A plunger is coupled with the pumping piston. An electromagnetic solenoid can actuate the plunger. A control device controls the solenoid to selectively actuate or release the plunger such that the pumping piston periodically pressurizes the lubricant.

The control device has a control map including an amount of lubricant required by the engine versus an engine speed and determines a frequency of energization of the solenoid using the control map.

SUMMARY OF THE INVENTION

One aspect of at least one of the inventions disclosed herein includes the realization that the frequency and/or the ON-time of a lubrication pump can be adjusted to overcome problems associated with low speed, low load, and low temperature operation. During normal operation, e.g., operation at normal lubricant temperatures, above-idle engine speeds or higher engine loads, the frequency of pump actuation can be determined such that an ON-time of the solenoid is fixed to a constant period of time that is the maximum period of time in which the pumping piston can fully move. In other words, the maximum period of time corresponds to an ON-time sufficient to move the piston of the lubrication pump over a full stroke.

Although the ON-time can be set longer than the "maximum time", no further movement of the piston will result because the piston will have reached a limit of travel. Additionally, if the ON-time is set longer than the time sufficient to cause the piston to move over an entire stroke, there will be less time to allow the piston to return to its initial position and begin the next stroke. Thus, the maximum ON-time used will generally be that time sufficient to cause the piston to move from one to another extreme position, i.e., a "full stroke". Additionally, the phrase "maximum time" could also be expressed as a minimum time required for a piston of the lubrication pump to move over a full stroke.

An OFF-time of the solenoid typically will include a sufficient period of time in which the pumping piston can return to an initial position. In determining the frequency, the control device can take account of an engine load alternatively or in addition to the engine speed.

Under normal operation, the determination of the frequency based on engine speed or load works satisfactorily when the engine speed is greater than a preset speed, e.g., the engine speed is in a middle or high speed range, or the engine load is greater than a preset load, e.g., the engine load is in a middle or high load range. This is because the engine requires a larger amount of lubricant in those ranges, causing the pump to operate almost continuously. However, is has been discovered that the lubricant can be insufficient, particularly at the end of the OFF-time of the solenoid when the engine speed is less than the preset speed and the engine load is less than the preset engine load, i.e., in a low speed and low load range because the engine requires a small amount of lubricant and the lubrication pump intermittently delivers the lubricant. This problem is more significant where a large size pump is used, that has a large dynamic range.

Generally, a pump with a longer piston stoke is more efficient for delivering lubricant, i.e., a greater volume per piston stroke. However, a longer stroke can cause a problem such that the pumping piston cannot complete a full stroke at an acceptable speed in low temperature due to the high viscosity of the lubricant. The pumping efficiency thus falls in low temperature accordingly.

The control device can apply a feed-back control (PI control) to control the lubricant pump because the feed-back control is particularly suitable for an engine assembled with various components and members that have tolerances, for an engine lubricated by an unspecified lubricant (e.g., having different viscosity) and for an engine used under unspecified conditions (e.g., under a different lubricant temperature).

In accordance with another aspect of at least one of the inventions disclosed herein, an internal combustion engine has a lubrication system to lubricate at least a portion of the engine with lubricant. The lubrication system has a lubrication pump that periodically pressurizes the lubricant toward the portion of the engine. At least one sensor senses either an engine speed or an engine load of the engine. A control device controls the lubrication pump. The control device determines a frequency of the periodic pressurization based upon a signal from the sensor. The control device sets a pressurizing time of the lubrication pump to a period of time shorter than the maximum period of time that can be set for the lubrication pump at the determined frequency, when the signal from the sensor indicates that the engine speed is less than a preset engine speed or the engine load is less than a preset engine load.

In accordance with a further aspect of at least one of the inventions disclosed herein, an internal combustion engine has a lubrication system to lubricate at least a portion of the engine with lubricant. The lubrication system has a lubrication pump that periodically pressurizes the lubricant toward the portion of the engine. A sensor senses either an engine speed or an engine load of the engine. A control device controls the lubrication pump. The control device primarily determines a frequency of the periodic pressurization based upon a signal from the sensor. The control device adjusts the frequency such that the adjusted frequency is higher than the primarily determined frequency, when a signal from the sensor indicates that the engine speed is less than a preset engine speed or the engine load is less than a preset engine load.

In accordance with another aspect of at least one of the inventions disclosed herein, an internal combustion engine has a lubrication system to lubricate at least a portion of the engine with lubricant. The lubrication system has a lubrication pump that periodically pressurizes the lubricant toward the portion of the engine. A sensor senses either an engine speed or an engine load of the engine. A control device controls the lubrication pump. The control device primarily determines a frequency of the periodic pressurization based upon a signal from the sensor. The control device adjusts the frequency such that the adjusted frequency is higher than the primarily determined frequency, when a signal from the sensor indicates that the engine speed is less than a preset engine speed or the engine load is less than a preset engine load.

In accordance with another aspect of at least one of the inventions disclosed herein, an internal combustion engine has a lubrication system configured to lubricate at least a portion of the engine with lubricant. The lubrication system has a lubrication pump that periodically pressurizes the lubricant toward the portion of the engine. A first sensor senses an operational condition of the engine. A second sensor senses a temperature of the lubricant. A control device controls the lubrication pump. The control device is configured to determine a first frequency of periodic pressurization based upon a signal from the first sensor. The control device is also configured to adjust the frequency such that the adjusted frequency is higher than the first frequency when a signal from the second sensor indicates that the temperature of the lubricant is less than a preset temperature.

In accordance with a further aspect of at least one of the inventions disclosed herein, an internal combustion engine has a lubrication system to lubricate at least a portion of the engine with lubricant. The lubrication system has a lubrication pump that periodically pressurizes the lubricant toward the portion of the engine. A first sensor senses either an engine speed or an engine load of the engine. A second sensor senses a temperature of the lubricant. A control device controls the lubrication pump. The control device is configured to determine a first frequency of the periodic pressurization based upon a signal from the first sensor. The control device is also configured to adjust the frequency such that the adjusted frequency is higher than the first frequency when the control device receives a signal from at least one of the first sensor indicating that the engine speed is less than a preset engine speed or the engine load is less than a preset engine load, and from the second sensor indicating that the temperature of the lubricant is less than a preset temperature.

In accordance with a yet another aspect of at least one of the inventions disclosed herein, an internal combustion engine has a lubrication system to lubricate at least a portion of the engine with lubricant. The lubrication system has a lubrication pump that periodically pressurizes the lubricant toward the portion of the engine. A first sensor senses an operational condition of the engine. A second sensor senses an actual amount of the lubricant delivered to the lubrication pump. A control device controls the lubrication pump. The control device determines a frequency of the periodic pressurization based upon a signal from the first sensor. The higher the frequency the more the actual amount of the lubricant. The control device determines a target amount of the lubricant based upon a signal from the first sensor. The control device adjusts the frequency with a first adjustment amount of the lubricant when the actual amount differs from the target amount. The control device further adjusts the frequency with a second adjustment amount of the lubricant when the actual amount still differs from the target amount. The first adjustment amount is greater than the second adjustment amount.

In accordance with a further aspect of at least one of the inventions disclosed herein, a method is provided for controlling a lubrication system that lubricates at least a portion of an engine. The lubrication system has a lubrication pump that periodically pressurizes the lubricant toward the portion of the engine. The method includes sensing at least one of an engine speed and an engine load of the engine, determining a frequency of the periodic pressurization based upon the engine speed or the engine load, determining whether the engine speed is less than a preset engine speed or the engine load is less than a preset engine load, and setting a pressurizing time of the lubrication pump to a period of time shorter than the maximum period of time that is capable to be set for the lubrication pump, when the determination of the engine speed or the engine load is affirmative.

In accordance with a further aspect of at least one of the inventions disclosed herein, a method is provided for controlling a lubrication system that lubricates at least a portion of an engine. The lubrication system has a lubrication pump that periodically pressurizes the lubricant toward the portion of the engine. The method includes sensing at least one of an engine speed and an engine load of the engine, determining a frequency of the periodic pressurization based upon the engine speed or the engine load, determining whether the engine speed is less than a preset engine speed or the engine load is less than a preset engine load, and adjusting the frequency such that the adjusted frequency is higher than the determined frequency when the determination of the engine speed or the engine load is affirmative.

In accordance with a still further aspect of at least one of the inventions disclosed herein, a method is provided for controlling a lubrication system that lubricates at least a portion of an engine. The lubrication system has a lubrication pump that periodically pressurizes the lubricant toward the portion of the engine. The method includes sensing an operational condition of the engine, sensing a temperature of the lubricant, determining a frequency of the periodic pressurization based upon the operational condition of the engine, determining whether the temperature of the lubricant is less than a preset temperature, and adjusting the frequency such that the adjusted frequency is higher than the determined frequency when the determination of the temperature is affirmative.

In accordance with a still further aspect of at least one of the inventions disclosed herein, a method is provided for controlling a lubrication system that lubricates at least a portion of an engine. The lubrication system has a lubrication pump that periodically pressurizes the lubricant toward the portion of the engine. The method includes sensing either an engine speed or an engine load of the engine, sensing a temperature of the lubricant, determining a frequency of the periodic pressurization based upon the engine speed or the engine load, determining whether the engine speed is less than a preset engine speed or the engine load is less than the preset engine load, determining whether the temperature of the lubricant is less than a preset temperature, and adjusting the frequency such that the adjusted frequency is higher than the determined frequency when the determination of the engine speed or the engine load is affirmative or the determination of the temperature is affirmative.

In accordance with a still further aspect of at least one of the inventions disclosed herein, a method is provided for controlling a lubrication system that lubricates at least a portion of an engine. The lubrication system has a lubrication pump that periodically pressurizes the lubricant toward the portion of the engine. The method includes sensing an operational condition of the engine, sensing an actual amount of the lubricant to the lubrication pump, determining a frequency of the periodic pressurization based upon the operational condition of the engine, the higher the frequency the more the actual amount of the lubricant, determining a target amount of the lubricant based upon the operational condition of the engine, determining whether the actual amount differs from the target amount, adjusting the frequency with a first adjustment amount of the lubricant when the determination of the difference is affirmative, determining whether the actual amount still differs from the target amount, and adjusting the frequency with a second adjustment amount of the lubricant when the second determination of the difference is affirmative. The first adjustment amount is greater than the second adjustment amount.

BRIEF DESCRIPTION OF THE DRAWINGS

These and other features, aspects and advantages of the inventions disclosed herein are described below with reference to the drawings of preferred embodiments, which are intended to illustrate and not to limit the inventions. The drawings comprise 17 figures in which:

FIG. 2(A) illustrates a position in which the lubrication pump does not operate and all the members are in stationary positions thereof.

FIG. 10 is a control map including adjustment coefficients correlated with temperatures;

DETAILED DESCRIPTION OF THE PREFERRED EMBODIMENTS

Overall Construction of Outboard Motor and a Two-Cycle Engine

Figure 1:
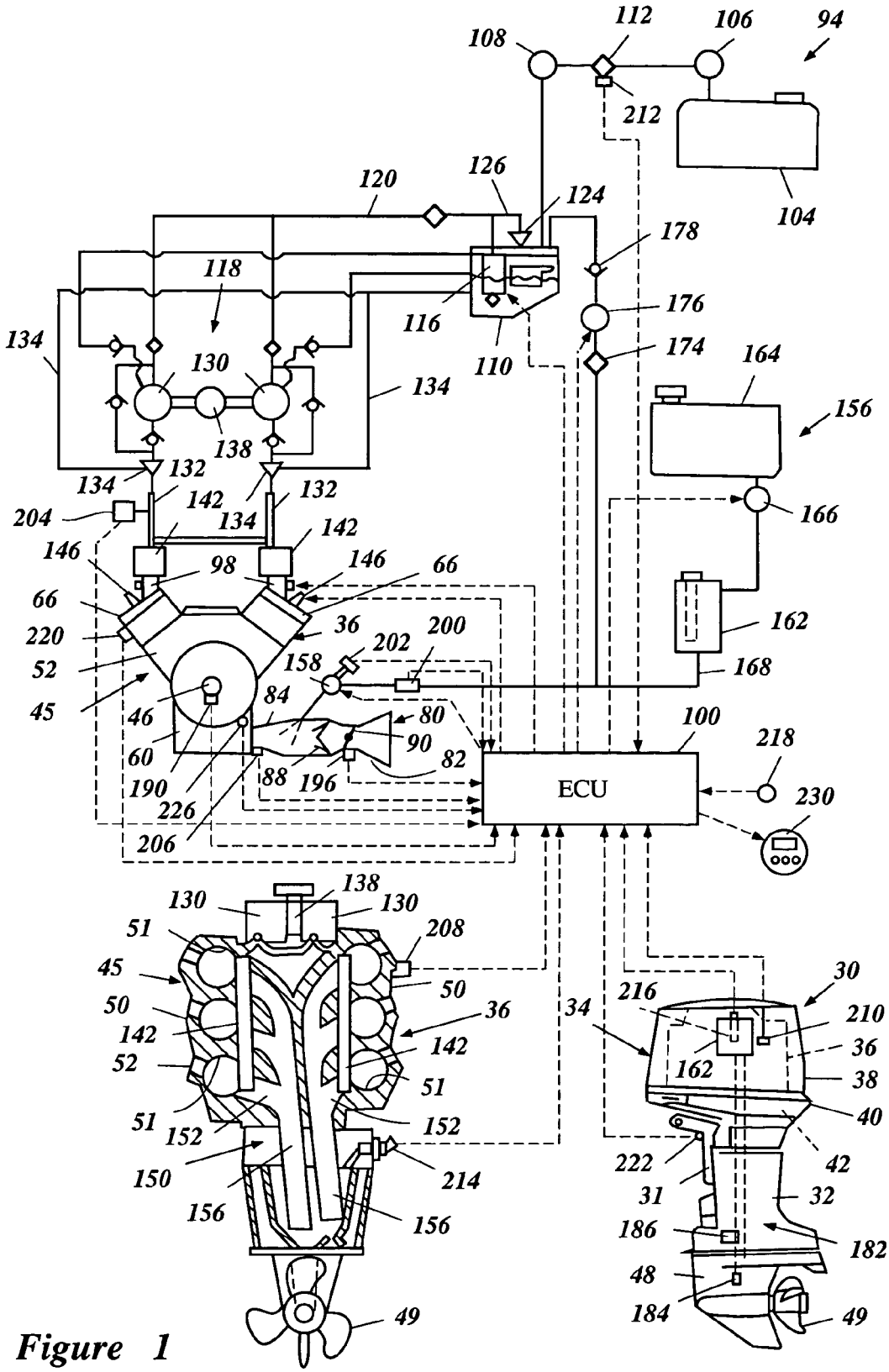
FIG. 1 is a multi-part view showing in the lower right-hand portion, an outboard motor that employs an engine having a lubrication system which relates to the present inventions; in the upper view, a partially schematic cross-sectional view of the engine of the outboard motor with the lubrication system, an air induction system and a fuel injection system shown in part schematically; and in the lower left-hand portion, a rear elevational view of the outboard motor with portions removed and other portions broken away and shown in cross section of the upper view so as to more clearly illustrate the construction of the engine, with the fuel injection system shown schematically in part, wherein an ECU for the motor links the three views together.

With reference to FIG. 1, an exemplifying environment in which the present inventions can be practiced are described below. The present lubrication system described below has particular utility in the context of a two-cycle engine for an outboard motor, and thus, is described in the context of such an outboard motor. The lubrication system, however, can be used with other types of two-cycle engines employed by any machines whatsoever using engine power such as, for example, watercrafts, land vehicles and utility machines.

With particular reference to the lower-right hand view of FIG. 1, an outboard motor 30 is depicted in a left side elevational view. The outboard motor 30 has a bracket assembly 31 comprising a swivel bracket and a clamping bracket which are typically associated with a driveshaft housing 32.

The outboard motor 30 includes a power head 34 that is positioned above the driveshaft housing 32. The power head 34 comprises a protective cowling assembly and an internal combustion engine 36. This engine 36 is illustrated in greater detail in the remaining two views of this figure, and is described in greater detail below.

The protective cowling assembly includes a top cowling member 38 and a bottom cowling member 40. The top and bottom cowling members 38, 40 together define a closed cavity in which the engine 36 is housed. The top cowling member 38 is detachably affixed to the bottom cowling member 40 such that a user or service person can access the engine 36 for maintenance service or other purposes. The top cowling member 38 preferably defines air intake openings on a rear, upper end surface. Air thus can be drawn into the cavity.

An engine support or exhaust guide 42 is unitarily or separately formed atop the driveshaft housing 32 and forms a tray together with the bottom cowling member 40. The tray can hold a bottom of the engine 36 and the engine 36 is affixed to the engine support 42.

The engine 36 comprises an engine body 45 (the upper and the lower-left hand views of FIG. 1) and a movable member which is movable relative to the engine body 45. The movable member in the illustrated engine 36 is a crankshaft 46 (the upper view of FIG. 1) that is rotatably journaled on the engine body 45. The crankshaft 46 rotates about a generally vertically extending axis. This facilitates the connection of the crankshaft 46 to a driveshaft (not shown) which depends into the driveshaft housing 32.

A lower unit 48 depends from the driveshaft housing 32. The propulsion device is mounted on the lower unit 48 and the driveshaft drives the propulsion device. The illustrated propulsion device is a propeller 49. The driveshaft drives the propeller 49 through a transmission disposed within the lower unit 48. The transmission includes a changeover mechanism that can change a rotational direction of the propeller 49 among forward, neutral and reverse. The propulsion device can take the form of a dual counter-rotating system, a hydrodynamic jet, or any of a number of other suitable propulsion devices.

With particular reference to the upper view and the lower left-hand view of FIG. 1, the engine 36 operates on a two-cycle, crankcase compression principle. The illustrated engine 36 is generally configured in a V-shape, with a pair of cylinder banks 50 extending generally rearwardly. Each bank 50 defines three cylinder bores 51. The cylinder bores 51 extend generally horizontally and are vertically spaced apart from each other in each bank 50. As used in this description, the term "horizontally" means that the subject portions, members or components extend generally in parallel to the water line where the associated watercraft is resting when the outboard motor 30 is not tilted. The term "vertically" in turn means that portions, members or components extend generally normal to those that extend horizontally. Although the invention is described in conjunction with the engine 36, the inventions disclosed herein can be utilized with an engine having other cylinder numbers and other cylinder configurations.

The engine body 45 includes a cylinder block 52. The cylinder block 52 forms the cylinder banks 50 in the illustrated arrangement. Other movable members are movable relative to the engine body 45. For example, other movable members in the illustrated engine 36 are pistons that are reciprocally disposed within the cylinder bores 51. The crankshaft 46 is journaled for rotation within a crankcase chamber defined in part by a crankcase member 60 that is affixed to the cylinder block 50 in a suitable manner. The pistons are coupled with the crankshaft 46 through connecting rods. The crankshaft 46 thus rotates with the reciprocal movement of the pistons.

Cylinder head assemblies 66 are affixed to each cylinder banks 50 to close open ends of the respective cylinder bores 51. Each cylinder head assembly 66 comprises a cylinder head member that defines a plurality of recesses (not shown) on its inner surface corresponding to the cylinder bores 51. Each of these recesses defines a combustion chamber together with the cylinder bore 51 and the piston. Cylinder head cover members complete the cylinder head assemblies 66. The cylinder head members and cylinder head cover members are affixed to each other and to the respective cylinder banks 50 in a suitable known manner.

The engine 36 preferably is provided with an air induction system 80 that delivers air to each section of the crankcase chamber associated with each cylinder bore 51. The induction system 80 comprises an air inlet device 82, an air intake manifold and a plurality of air intake conduits 84. The air inlet device 82 defines a plenum chamber through which the air is drawn into the induction system 80. The intake manifold is coupled with the inlet device 82. Each air intake conduit 84 is branched off from the intake manifold and defines an air intake passage connecting the plenum chamber and each section of the crankcase chamber associated with each combustion chamber. The air drawn into the plenum chamber thus is delivered to the sections of the crankcase chamber through the intake conduits 84.

Each intake conduit 84 preferably incorporates a reed valve 88 that allows the air to flow into the section of the crankcase chamber 60 and prevents the air in the section of the crankcase member 60 from flowing back to the plenum chamber. Each intake conduit 84 also incorporates a throttle valve 90 between the plenum chamber and the reed valve 88. Each throttle valve 90 is pivotally journaled on each intake conduit 84 to regulate an amount of flowing therethrough. The operator can change the pivotal position, i.e., throttle position, through a suitable control mechanism (not shown).

The air drawn into the respective sections of the crankcase chamber is preliminary compressed by the pistons, during their movement toward the crankshaft. The air, then, moves into the combustion chambers through a scavenge system. The scavenge system preferably is formed as a Schnurle-type system that comprises a pair of main scavenge passages connected to each cylinder bore 51 and positioned on diametrically opposite sides. These main scavenge passages terminate in main scavenge ports so as to direct scavenge air flows into the combustion chamber.

In addition, an auxiliary scavenging passage is formed between the main scavenge passages and terminates in an auxiliary scavenging port which also provides a scavenge air flow. Thus, at the scavenge stroke, the air in the crankcase chamber is transferred to the combustion chambers to be further compressed by the pistons during their movement toward the head member. The scavenge ports are selectively opened and closed as the piston reciprocates.

The engine 36 preferably is provided with a fuel supply system 94 that delivers fuel to the combustion chambers. The illustrated fuel supply system 94 is configured to operate under a direct fuel injection principle in which the fuel is directly sprayed into the combustion chambers.

The fuel supply system 94 comprises fuel injectors 98 allotted to the respective combustion chambers. The fuel injectors 98 preferably are mounted on the cylinder head assemblies 66. An electronic control unit (ECU) 100 controls the fuel injectors 98 to inject fuel. The ECU 100 preferably controls the duration of each injection.

The ECU 100 comprises at least a central pressing unit (CPU) and at least one memory portion. The ECU 100 controls engine components such as, for example, the fuel injectors 98, in response to conditions collected by sensors. The memories store control programs and control references.

In the illustrated ECU 100, the memories store control maps, described below, as the control references. The CPU executes the control routines with reference to the control maps based upon signals from the sensors and sends control signals to the engine components. The sensors are described in greater detail below.

The fuel supply system 94 additionally comprises a fuel supply tank 104 that preferably is placed in the hull of the watercraft. A first low pressure pump 106 and one or a plurality of second low pressure pumps 108 draw the fuel from the tank 104 into a vapor separator 110. The first low pressure pump 106 can be a manually operated pump. The second low pressure pumps 108 preferably are diaphragm-type pumps operated by pulsation that occur in the sections of the crankcase chamber.

A quick disconnect coupling is provided in a conduit that connects the first low pressure pump 106 to the second low pressure pumps 108 to detachably connect the watercraft side of the conduit with the outboard side thereof. A fuel filter 112 is positioned between the first low pressure pump 106 and the second lower pressure pumps 108. The fuel filter 112 removes foreign substances such as, for example, particles and water in the fuel.

The illustrated vapor separator 110 is a fuel reservoir in which the fuel can be reserved. The vapor separator 110 has an inner construction that can separate vapor from the fuel to prevent the vapor lock from occurring in the fuel supply system 94.

An electric pump 116 preferably is disposed in the cavity of the vapor separator 110. The electric pump 116 pressurizes the fuel in the vapor separator 110 to a high pressure pump unit 118 through a preload (or pre-pressure) fuel passage 120. The pressure developed by the electric pump 116 is greater than the pressure developed by the low pressure pumps 108; however, is less than a pressure developed by the high pressure pump unit 118. In other words, the electric pump 116 develops a pressure to a certain level and the high pressure pump unit 130 raises the pressure to a higher level.

A preload regulator 124 is provided in a return passage 126 connecting the preload fuel passage 120 with the vapor separator 110 to return excessive fuel to the vapor separator 110. As such, the preload regulator 124 limits the pressure that is delivered to the high pressure fuel pump unit 118 by dumping fuel back to the vapor separator 110, and thereby bleeding pressure in excess of the pressure at which the regulator 124 is configured to open.

The high pressure pump unit 118 preferably comprises a pair of high pressure pumps 130. The illustrated preload passage 120 is bifurcated into two sections and is connected to the pumps 130. High pressure fuel passages 132 extend from the respective pumps 130. Flexible conduits preferably define the fuel passages 132. High pressure regulators 134 are disposed in the respective fuel passages 132 to regulate the high pressure at a fixed or constant high pressure. Excessive fuel returns back to the vapor separator 110 through return passages 134.

The high pressure pump unit 118 preferably is disposed atop and at the rear of the cylinder block 52. More specifically, the illustrated pump unit 118 is generally positioned between both of the banks 50. The pump unit 118 is affixed to the cylinder block 52 so as to overhang between the two banks 52 of the V arrangement. In the illustrated arrangement, the high pressure pump unit 118 comprises a pump drive 138. The high pressure fuel pumps 130 are disposed on both sides of the pump drive 138 and affixed thereto.

The pump drive 138 has a driveshaft. A cam disc is affixed onto the driveshaft and is engaged with plungers of the respective high pressure pumps 130. The high pressure fuel pumps 130 pressurize the fuel with the plungers when the cam disc pushes the plungers when the driveshaft rotates. A driven pulley preferably is affixed atop of the driveshaft. Also, a drive pulley is affixed atop of the crankshaft 46. An endless drive belt is wound around the driven and drive pulleys. The crankshaft 46 thus drives the driveshaft of the pump drive 138.

The high pressure fuel passages 132 are connected to respective fuel rails 142. The fuel rails 142 couple the fuel passages 132 with the respective fuel injectors 98. The fuel rails 142 are affixed to the respective cylinder head assemblies 66 so as to extend generally vertically. Preferably, the fuel injectors 98 are coupled to the fuel rails 142 with the respective internal fuel paths of the injectors 98 connected with the internal passages of the fuel rails 142. Additionally, the fuel injectors 98 preferably are affixed to each cylinder assembly 66.

With continued reference to FIG. 1, the engine 36 preferably is provided with an ignition or firing system. Spark plugs 146 are affixed to the cylinder head assemblies 66 so as to expose into the combustion chambers. The spark plugs 146 ignite air/fuel charges in the combustion chambers also under control of the ECU 100.

With reference to the lower left-hand view of FIG. 1, the engine 36 preferably is provided with an exhaust system 150 that guides burned charges, i.e., exhaust gases to an external location from the combustion chambers. The illustrated exhaust system 150 discharges the exhaust gases to the body of water surrounding the outboard motor 30 during above idle speed operation. At idle speeds, the exhaust gasses are discharged to the atmosphere through an above-water outlet.

Each cylinder bore 51 has an exhaust port 152 which is selectively opened or closed with the piston reciprocating. A pair of exhaust manifolds 156 connects the exhaust ports 152 on each bank 50 with each other, and lead the exhaust gases into the driveshaft housing 32 through the engine support 42.

The driveshaft housing 32 and the lower unit 48 define an exhaust gas discharge mechanism connected to a hub of the propeller 49. The hub of the propeller 49 defines an opening through which the exhaust mechanism communicates with the body of water. Thus, the exhaust gases produced at above idle engine speeds are discharged to the body of water through the exhaust discharge mechanism and the propeller hub. The driveshaft housing 32 preferably defines an idle exhaust gas discharge mechanism.

Each fuel injector 98 sprays fuel directly into the associated combustion chamber. The sprayed fuel is mixed with the air delivered through the scavenge passages to an air/fuel charge. The spark plug 146 fires the air/fuel charge. The injection timing and duration of the fuel injection and the firing timing are under control of the ECU 100. Once the air/fuel charge burns in the combustion chamber, each piston is moved by the pressure produced in the combustion chamber. At this time, each exhaust port 152 is uncovered.

The burnt charge or exhaust gases thus are discharged through the exhaust system 150.

With reference to the upper view of FIG. 1, the engine 36 is provided with the foregoing lubrication system, indicated by the reference numeral 156. The lubrication system 156 preferably comprises a lubrication pump 158. The lubrication pump 158 periodically pressurizes lubricant toward portions of the engine 36 that benefit from lubrication.

In the illustrated arrangement, the lubrication pump 158 has one inlet port and six outlet ports. The outlet ports are connected to the respective intake passages of the intake conduits 84 and positioned downstream of the reed valves 88. The lubricant is drawn into the crankcase chamber together with the air and is delivered to the engine portions such as, for example, connecting portions of the connecting rods with the pistons and also with the crankshaft 46.

A main lubricant tank 162 and a sub-tank 164 are arranged upstream of the lubrication pump 158. The main tank 162 preferably is mounted on either one of the cylinder banks 50, and the sub-tank 164 placed upstream of the main tank 162 and preferably in the hull of the associated watercraft.

A supply pump 166 is disposed between the sub-tank 164 and the main tank 162 to supply the lubricant in the sub-tank 164 to the main tank 162 under control of the ECU 166. The lubricant is delivered to the inlet port of the lubrication pump 158 through a lubricant supply passage 168. The lubrication pump 158 injects the lubricant into each intake passage of the intake conduit 84 through each outlet port. The ECU 100 controls the injection of the lubricant as is described in greater detail below. The structure and operation of the lubrication pump 158 is also described in greater detail below with reference to FIGS. 2(A)–(C).

In the illustrated arrangement, some forms of direct lubrication can be additionally employed for delivering lubricant directly to certain engine portions. For example, a lubricant delivery passage 172 can be branched off from the lubricant supply passage 168 to connect the lubrication system 156 with the fuel supply system 94.

A filter 174, a lubricant delivery pump 176 and a check valve 178 are disposed in the lubricant delivery passage 172. The filter 174 removes foreign substances from the lubricant. The lubrication delivery pump 176 pressurizes the lubricant to the vapor separator 110 under control of the ECU 100. The check valve 178 allows the lubricant to flow to the vapor separator 110 from the lubrication system 156 and prevents the lubricant from flowing back to the lubrication system 156 from the fuel supply system 94. Thus, a portion of the lubricant in the lubrication system 156 is directly supplied to the engine portions that need lubrication.

The engine 36 and the exhaust system 150 can build significant heat during engine operations. With reference to the lower right-hand view of FIG. 1, the outboard motor 30 preferably is provided with a cooling system 182 that cools the engine body 45 and the exhaust system 150. The cooling system 182 preferably is an open-loop type that introduces cooling water from the body of water and discharges the water to the body of water. A water inlet 184 is defined at a side surface of the lower unit 48 submerged when the outboard motor 30 is under a normal operating condition. A water pump 186 pressurizes the water to the water jackets of the engine body 45 and the exhaust system 150. After traveling through the engine body 45 and the exhaust system 150, the water is discharged to the body of water together with the exhaust gases through the hub of the propeller 49.

As described above, the ECU 100 controls at least the fuel injectors 98, the spark plugs 146, the electric pump 116, the lubrication pump 158, the lubricant supply pump 166 and the lubricant delivery pump 176. In order to control these components, the outboard motor 30 is provided with a number of sensors that sense either engine running conditions, ambient conditions or conditions of the outboard motor 30 that can affect engine performance.

For example, there is provided a crankshaft angle position sensor 190 that, when measuring crankshaft angle versus time, outputs a crankshaft rotational speed signal to the ECU 100. The ECU 100 can calculate an engine speed using the crankshaft rotational speed signal. In this regard, the crankshaft angle position sensor 190 and part of the ECU 100 form an engine speed sensor. The crankshaft angle position sensor 190, or another sensor, can also be used to provide reference position data to the ECU 100 for timing purposes, such as for the timing of fuel injection and/or ignition timing.

Operator demand or engine load, as indicated by a throttle angle of the throttle valve 90, is sensed by a throttle position sensor 196 which outputs a throttle position or load signal to the ECU 100. Alternatively or additionally, an intake pressure sensor can be provided close to the throttle position sensor 196 to sense the intake pressure that can also represent the engine load.

A flow amount sensor 200 can be provided at the lubricant supply passage 168 to sense an amount of lubricant that flows through the lubricant passage 168 and output a flow amount signal to the ECU 100. A lubricant temperature sensor 202 is provided at the lubrication pump 158 to sense a temperature of the lubricant at the pump 158 and output a lubricant temperature signal to the ECU 100.

Preferably, other than those sensors, there are a fuel pressure sensor 204 detecting a fuel pressure in one of the high pressure fuel passages 132, an intake air temperature sensor 206 detecting a temperature of the intake air, an oxygen ($O_2$) sensor 208 detecting a residual amount of oxygen in the exhaust system 150, a water temperature sensor 210 detecting a temperature of the cooling water, a water amount sensor 212 detecting an amount of water removed by the fuel filter 112, an exhaust pressure sensor 214 detecting an exhaust pressure in the exhaust system 150, a lubricant level sensor 216 detecting an amount of lubricant in the main lubricant tank 162, a knock sensor 218 detecting a knocking, an engine temperature sensor 220 detecting a temperature of the engine body 45 and a trim sensor 222 detecting a trim position of the outboard motor 30 relative to the associated watercraft.

A pulsar coil 226 can also be provided at a flywheel magneto, which is driven by the crankshaft 46 to generate electric power. The pulsar 226 generates pulses that provide basic signals of the respective ignition timings.

An indicator or meter 230 preferably is provided to show some of the detected conditions such as, for example, a residual amount of the lubricant in the main tank 162. The indicator 230 also indicates warnings such that a certain component malfunctions, a certain temperature is abnormal, the lubricant amount is lower than a preset amount or other various conditions. The ECU 100 provides signals indicative of those conditions to the indicator 230. A buzzer or sounder can alternatively or additionally be provided to indicate warnings.

Lubrication Pump

Figure 2C:
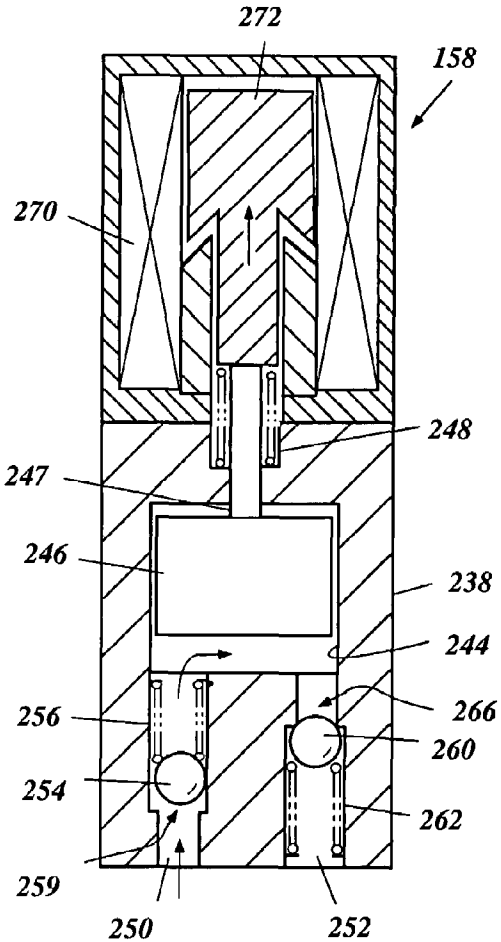
FIG. 2(C) illustrates a position in which the solenoid releases the plunger and the pumping piston returns to an initial position.
Figure 2B:
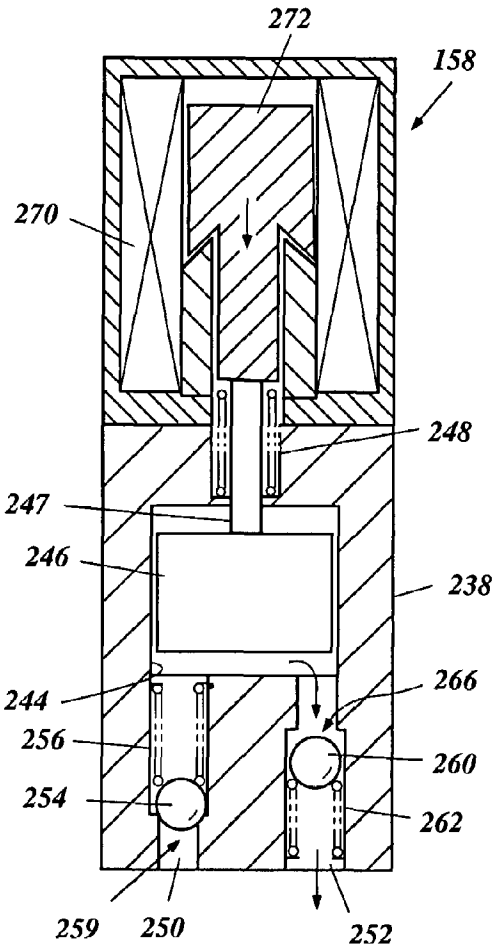
FIG. 2(B) illustrates an electromagnetic solenoid of the lubrication pump actuating a plunger thereof under control of the ECU and a pumping piston of the pump pressurizing lubricant.
Figure 2A:
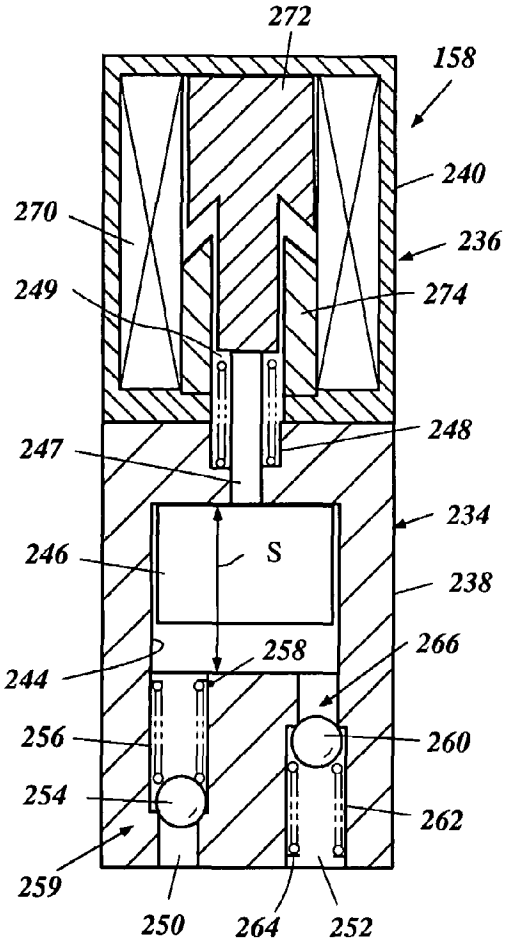
FIGS. 2(A), (B) and (C) are schematic views of a lubrication pump applied in the lubrication system of FIG. 1.

With reference to FIGS. 2(A)–(C), a structure and an operation of the lubrication pump 158 is described below. It should be noted that the actual lubrication pump 158 has six outlet ports connected to the respective intake passages of the intake conduits 84 as described above, although FIGS. 2(A)–(C) schematically illustrates only one outlet port.

With initial reference to FIG. 2(A), the lubrication pump 158 preferably comprises a pump unit 234 and a solenoid unit 236. The pump unit 234 has a pump housing 238, while the solenoid unit 236 has a solenoid housing 240. Both housings 238, 240 are coupled with each other by fastening members such as, for example, screws.

The pump housing 238 defines a cavity 244 in which a pumping piston 246 is reciprocally disposed. The pumping piston 246 can move in a stroke range S. That is, the stroke range S is the maximum range. The pumping piston 246 can fully move in this range S.

The pump housing 238 defines an opening communicating with an inside of the solenoid housing 240. A piston rod 247 extends from the piston 246 through the opening and enters the inside of the solenoid housing 240 beyond a distal end of the pump housing 238. The opening is widened toward the inside of the solenoid housing 240 to form a step. The piston rod 247 has a retainer 249 at a portion in close proximity to its end. A coil spring 248 is placed between the step and the retainer 249 to bias the piston rod 247 toward the solenoid unit 236. Thus, the pumping piston 246 normally is biased toward the position shown in FIG. 2(A).

The cavity 244 also communicates outside through inlet and outlet ports 250, 252 generally on a side opposite to the solenoid unit 236. In the illustrated arrangement, the inlet port 250 is connected to the lubricant supply passage 168 and the outlet ports 252 are connected to the respective intake passages of the intake conduits 84 as described above.

The inlet port 250 is narrowed toward the outside from a mid portion of the port 250 to form a step. A ball 254 is positioned at the step so as to be movable toward the cavity 244. A coil spring 256 is placed between the ball 254 and a retainer 258 formed at an inner surface of the inlet port 250 to bias the ball 254 onto the step. The inlet port 250 is closed when the ball 254 is seated at the step. The ball 254 normally is seated at the step. The ball 254 and the spring 256 together form a check valve 259 that allows the lubricant to flow into the cavity 244 and prevents the lubricant from flowing out from the cavity 244.

Similarly, each outlet port 252 is narrowed toward the cavity 244 from a mid portion of the port 252 to form a step. A ball 260 is positioned at the step so as to be movable toward the outside. A coil spring 262 is placed between the ball 260 and a retainer 264 formed at an inner surface of the outlet port 252 to bias the ball 260 onto the step. The outlet port 252 is closed when the ball 260 is seated at the step. The ball 260 normally is seated at the step. The ball 260 and the spring 262 together form a check valve 266 that allows the lubricant to flow outside and prevents the lubricant from flowing back to the cavity 244.

The solenoid unit 236 incorporates an electromagnetic solenoid 270, a plunger 272 and a stopper 274 in the solenoid housing 240. The solenoid 270 surrounds the plunger 272 so as to allow the plunger 272 to axially move therein. An end of the plunger 272 abuts the piston rod 247 and pushes the piston rod 247 toward the check valves 259, 266 when the plunger 272 is actuated. The stopper 274 limits the maximum stroke of the plunger 272 such that the piston rod 247 is not further pressed after the piston 246 has fully moved over the maximum stroke S.

The solenoid 270 is energized when an ON signal is provided from the ECU 100 and is de-energized when an OFF signal is provided or when the ON signal is not provided. The solenoid 270 actuates the plunger 272 while energized and releases the plunger 272 while de-energized. The lubricant fills the remainder space in the cavity 244 and the inlet and outlet ports 250, 252 in an initial state that is shown in FIG. 2(A).

With reference to FIG. 2(B), the pumping piston 246 moves toward the inlet and outlet ports 250, 252 while the solenoid 270 is energized and the plunger 272 pushes the piston 246. The piston 246 pressurizes the lubricant in the cavity 244. The lubricant in the cavity 244 thus moves out through each outlet port 252 toward the intake passage because each check valve 266 opens. The check valve 259 closes at this moment.

With reference to FIG. 2(C), the pumping piston 246 returns back to the initial position while the solenoid 270 is de-energized to release the plunger 272. The check valve 259 opens because the cavity 244 is decompressed and the lubricant is drawn into the cavity 244 through the lubricant delivery passage 168. The check valve 252 closes at this moment.

Preferably, the ECU 100 provides the solenoid 270 with a sequential control signal in which a high voltage part and a low voltage part alternately and repeatedly appear, which is also known as a "duty cycle". The high voltage part corresponds to the ON signal and the low voltage part corresponds to the OFF signal. As used in this description, the term "ON-time" means a period of time in which the high voltage part or the ON signal continues, which can also correspond to a pulse width. The term "OFF-time" means a period of time in which the low voltage part or the OFF signal continues. Also, the term "the maximum period of time" or "maximum ON-time" in this description means a period of time in which the piston 138 can fully move in the cavity 244. An ON-time having a magnitude less than the maximum ON-time is not sufficient to cause the piston 138 to move by the full stroke S.

An amount Q of the lubricant injected by the lubrication pump 158 per unit time is in proportion to a frequency or cycle of the sequential control signal in which the ON-time and the OFF-time alternate from one another. The frequency can vary. The frequency preferably is determined by the ECU 100 such that the ON-time of the solenoid 270 is fixed to a constant period of time that is the maximum period of time in which the pumping piston 246 can fully move over the stroke S, and that an OFF-time of the solenoid 270 includes a sufficient period of time in which the pumping piston 246 can return to the initial position. The OFF-time can be longer than the ON-time.

Also, as used in this description, the term "periodically pressurize" or "periodic pressurization" means that the lubrication pump 158 intermittently pressurizes the lubricant with the high voltage part of the sequential control signal or the ON signal provided to the solenoid 270. Also, the term "pressurizing time of a (the) lubricant pump" means a period of time in which the lubrication pump 158 pressurizes the lubricant with the high voltage part of the sequential control signal or the ON signal.

First Control Method

With reference to FIGS. 3–7, a first control method of the lubrication pump 158 is described below.

The first control method can be stored as a control routine 300 (FIG. 3) in one of the memories of the ECU 100. The ECU 100, using the control routine 300, controls the lubrication pump 158 differently in a low engine speed and low engine load range compared with the operation in other ranges.

Figure 3:
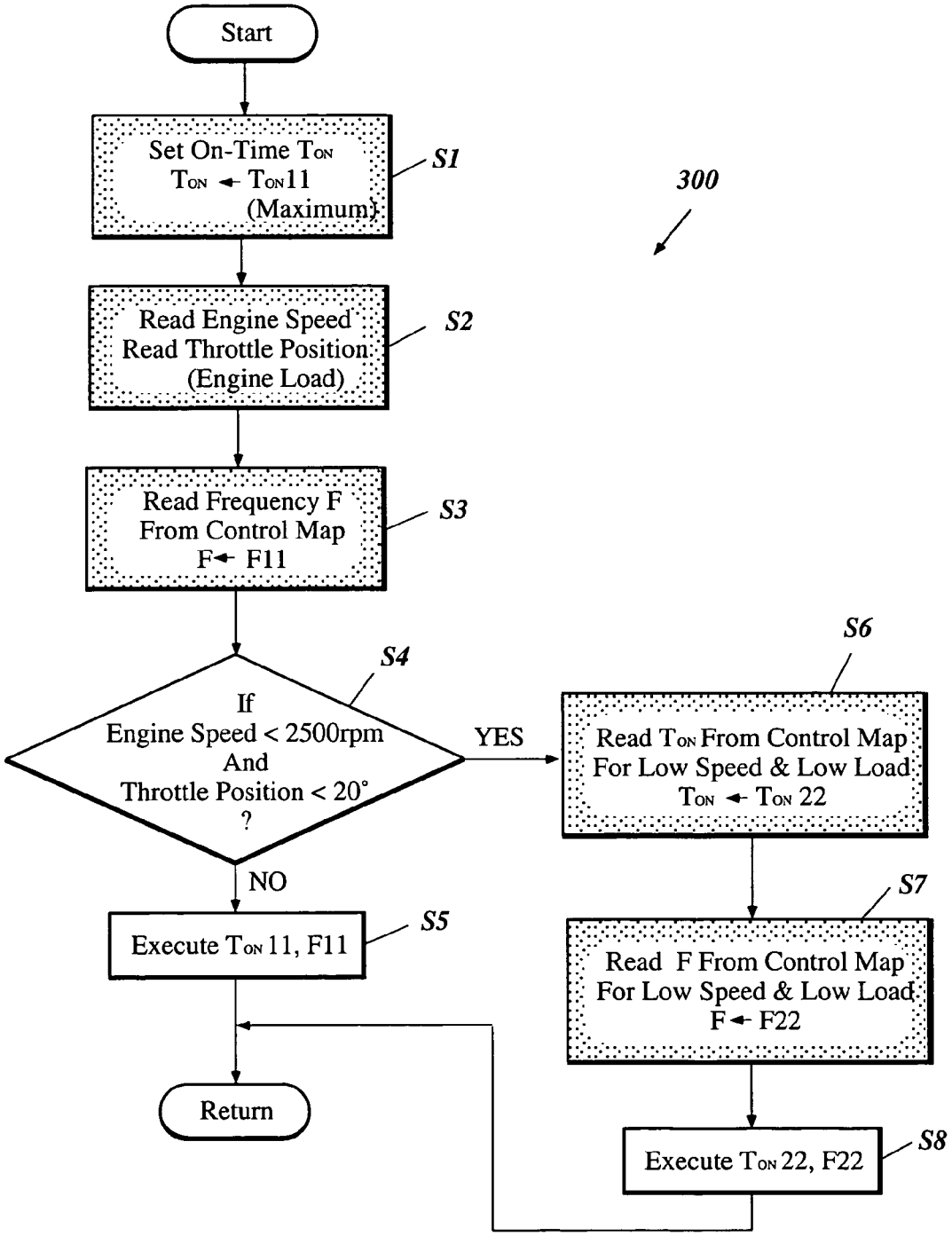
FIG. 3 is a flow chart illustrating a control routine for operating a lubrication pump in accordance with one embodiment of at least one of the inventions disclosed herein.

With initial reference to FIG. 3, the control routine 300 starts and proceeds to a step S1. The ECU 100, at the step S1, sets an ON-time $T_{ON}$11 as an initial ON-time $T_{ON}$. The ON-time $T_{ON}$11 is a constant period of time and also is the maximum period of time. The routine 300 then goes to a step S2 and the ECU 100 reads an engine speed sensed by the engine speed sensor 190 (in the strictly meaning, the sensor 190 and part of the ECU 100, as described above), and a throttle position that represents an engine load. The routine 300 moves to a step S3.

Figure 5:
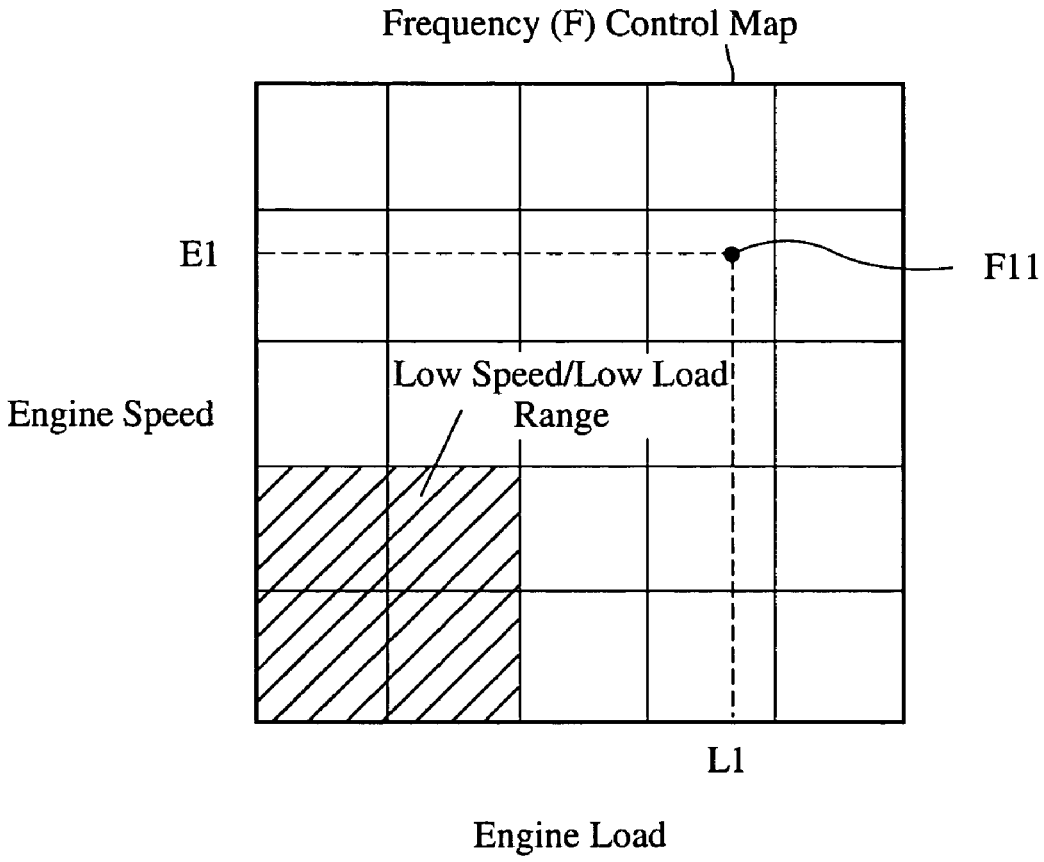
FIG. 5 is a control map including a frequency of periodic pressurization of the lubrication pump versus the engine speed and the engine load of the engine, wherein the hatched area of the figure illustrates a frequency range corresponding to the low engine speed low load of the engine.
Figure 6:
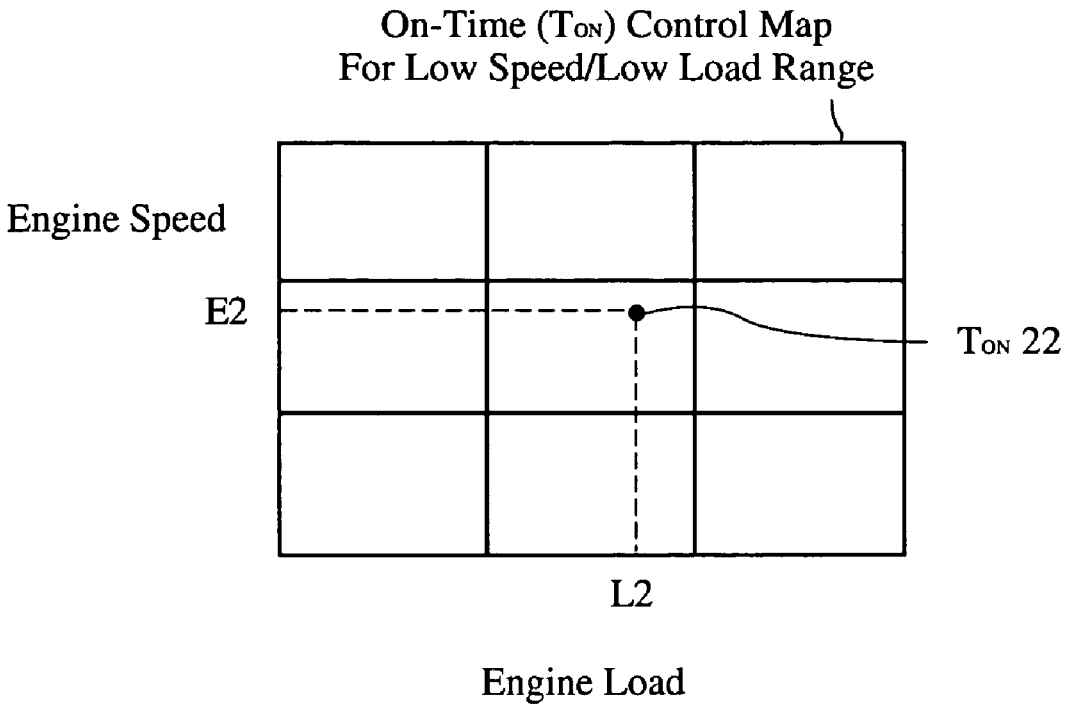
FIG. 6 is a control map including a period of ON-time of the solenoid versus engine speed and the engine load of the engine in a low engine speed and low engine load range of the engine.

The ECU 100, at the step S3, reads a frequency F of the periodic pressurization corresponding to the engine speed and the engine load from a control map of FIG. 5 and sets the frequency F as an initial frequency. For example, if the engine speed is E1 and the engine load is L1, then the frequency is F11. The routine 300 then goes to a step S4.

At the step S4, the ECU 100 determines whether the engine speed is less than a preset engine speed and the engine load is less than a preset engine load. In this routine 300, the preset engine speed is 2,500 rpm and the preset engine load is the engine load that corresponds to the throttle position of 20 degrees.

If the determination at the step S4 is negative, the routine 300 proceeds to a step S5 and the ECU 100 energizes the solenoid 270 with the initial ON-time $T_{ON}$11 and the initial frequency F11. The routine 300 then returns back to the step S1 to repeat the step S1.

Figure 4:
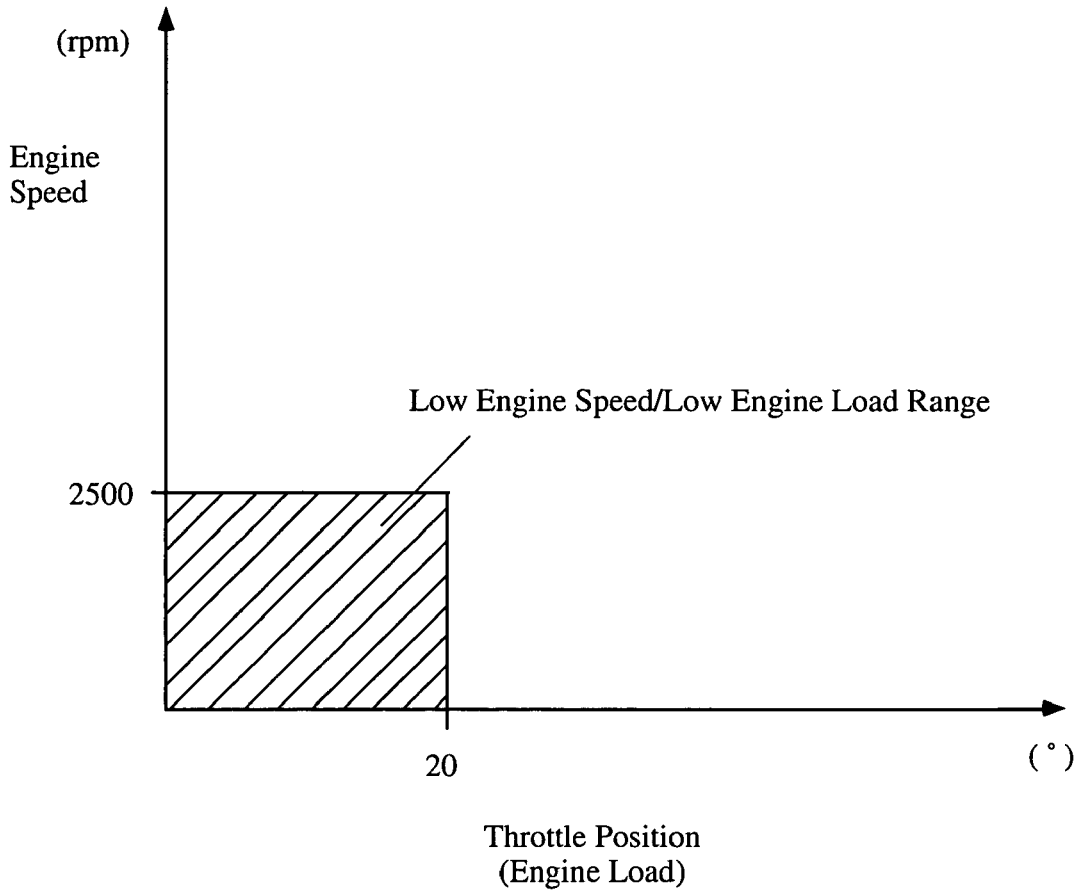
FIG. 4 is a chart illustrating an operational range of the engine in which an engine speed and a throttle valve opening (i.e., an indication of engine load) are parameters to determine the operational range, wherein the hatched area of the figure illustrates a range of a low engine speed and low load range.

If the determination at the step S4 is affirmative, the ECU 100 recognizes that both the engine speed and the engine load fall in a low range that is indicated by the hatched area of FIG. 4. The routine 300 then proceeds to a step S6 to set an ON-time $T_{ON}$ that varies corresponding to the engine speed and the engine load. That is, the ECU 100, at the step S6, reads an ON-time $T_{ON}$ corresponding to the engine speed and the engine load in referring to the ON-time control map of FIG. 6 for a low engine speed and low engine load range. For example, if the engine speed is S2 and the engine load is L2, then the ON-time is $T_{ON}$22. The ON-time for the low engine speed and low engine load is shorter than the initial ON-time, i.e., the maximum ON-time (e.g., $T_{ON}$22<$T_{ON}$11). Then, the routine 300 proceeds to a step S7.

Figure 7:
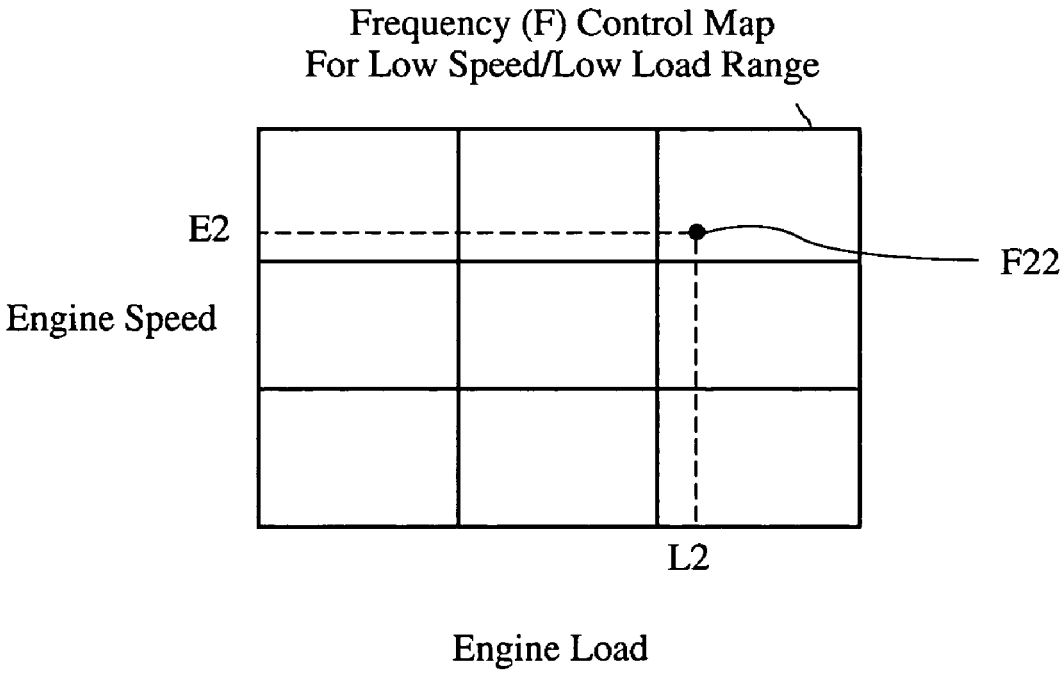
FIG. 7 is a control map including the frequency versus the engine speed and the engine load of the engine in the low engine speed and low load range of the engine.

At the step S7, the ECU 100 reads a frequency corresponding to the engine speed and the engine load in referring to the frequency control map of FIG. 7 for the low engine speed and low engine load range. For example, if the engine speed is E2 and the engine load is L2, then the frequency is F22. The frequency for the low engine speed and low engine load is higher than a frequency that could be set if the ON-time is the maximum (i.e., the latter frequency could be set using the hatching area of FIG. 5). That is, the frequency found in the control map of FIG. 7 whatsoever is higher than the frequency that could be normally found in the control map of FIG. 5 both corresponding to the same engine speed and engine load.

The routine 300 proceeds to a step S8 and the ECU 100 energizes the solenoid 270 with the ON-time $T_{ON}$22 and the frequency F22. The routine 300 then returns back to the step S1 to repeat the step S1.

As thus described, in this first control method, the ON-time of the solenoid is set shorter than the maximum period of time when the engine speed is less than 2,500 rpm and the throttle position (representing the engine load) is less than 20 degrees. The frequency thus can be set higher than a frequency that could be set if the ON-time is the maximum. Accordingly, the lubrication pump can inject a sufficient amount of the lubricant at a proper frequency even in the low speed and low load range.

Second Control Method

With reference to FIGS. 5 and 8–10, a second control method of the lubrication pump 158 is described.

In general, a longer stoke of the pumping piston is more efficient because more lubricant is delivered per stroke. However, a long stroke can cause a problem such that the pumping piston cannot move over its full stroke when the lubricant is at a low temperature due to the high viscosity of the lubricant. Thus, pumping efficiency can fall in low temperature.

The second control method can resolve such a problem. The second control method can be stored as a control routine 310 in one of the memories of the ECU 100. The ECU 100, using the control routine 310, controls the lubrication pump 158 differently from a normal control if a lubricant temperature is lower than a preset temperature.

Figure 8:
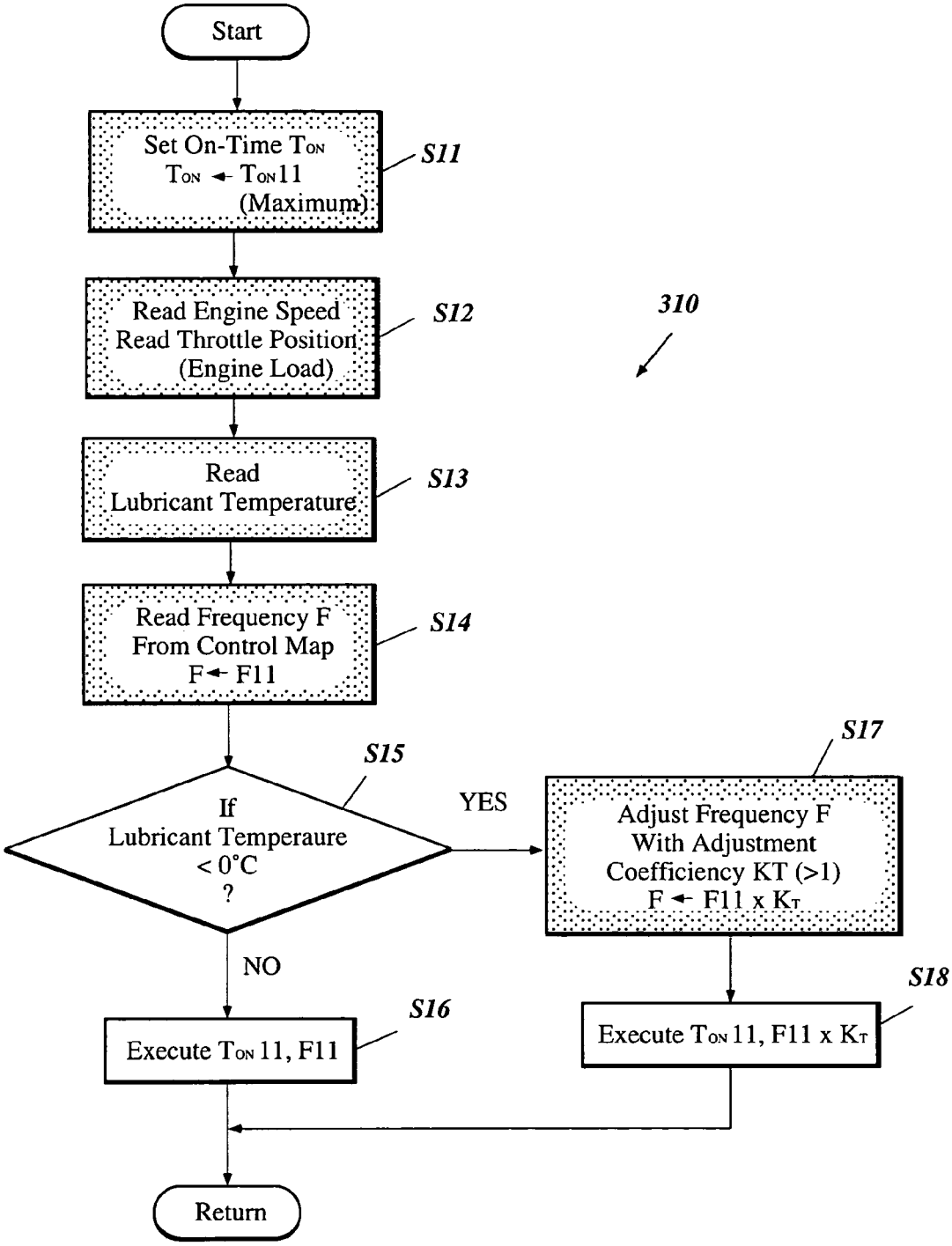
FIG. 8 is a flow chart illustrating a modified control routine for operating a lubrication pump in accordance with another embodiment of at least one of the inventions disclosed herein.

With initial reference to FIG. 8, the control routine 310 (FIG. 8) starts and proceeds to a step S11. The ECU 100, at the step S11, sets an ON-time $T_{ON}$11 as an initial ON-time. The ON-time $T_{ON}$11 is a constant period of time and also is the maximum period of time. The routine 310 then goes to a step S12 and the ECU 100 reads an engine speed sensed by the engine speed sensor 190 (e.g., the sensor 190 and part of the ECU 100, as described above), and a throttle position that represents an engine load. The routine 310 moves to a step S13.

The ECU 100, at the step S13, reads a temperature of the lubricant at the lubrication pump 158 and goes to a step S14.

The ECU 100, at the step S14, reads a frequency F of the periodic pressurization corresponding to the engine speed and the engine load from a control map of FIG. 5 and sets the frequency F as an initial frequency. Similarly to the first control method, if the engine speed is E1 and the engine load is L1, then the frequency is F11, for example. The routine 310 then goes to a step S15.

Figure 9:
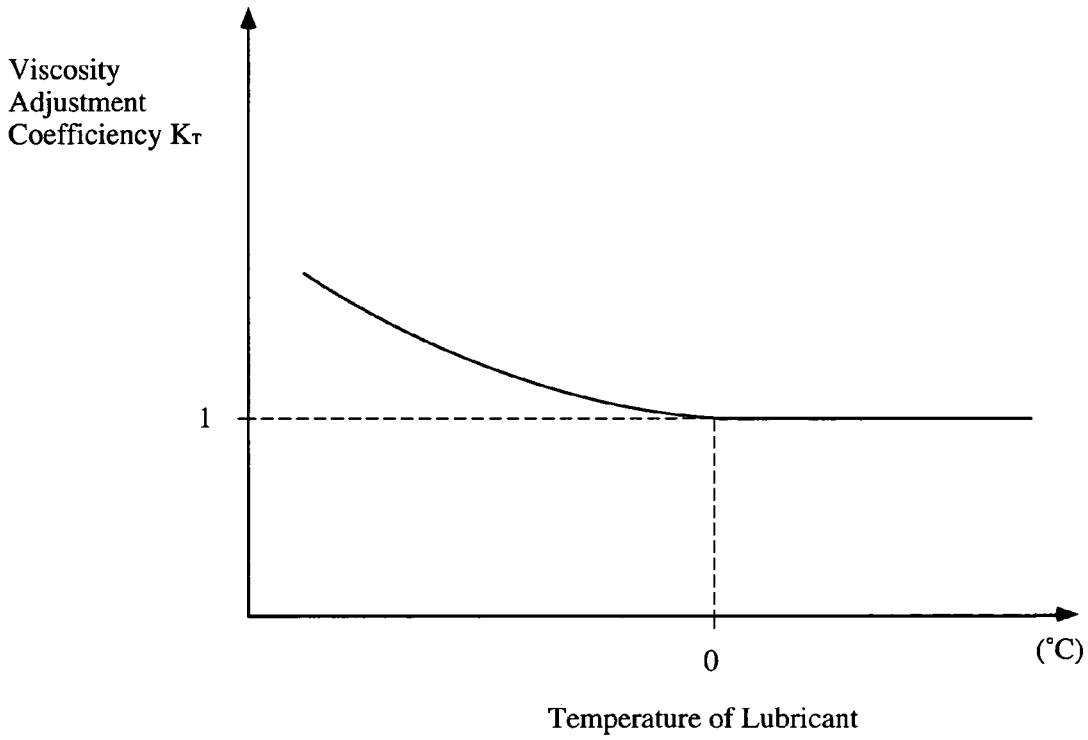
FIG. 9 is a chart illustrating a relationship between a temperature and a viscosity of the lubricant and also a relationship between a temperature of lubricant and an adjustment coefficient.

At the step S15, the ECU 100 determines whether the lubricant temperature is lower than a preset temperature. In this control, the preset temperature is zero degree Celsius (0° C.) because the viscosity of the lubricant rises significantly below 0° C. as shown in FIG. 9.

If the determination at the step S15 is negative, the routine 310 proceeds to a step S16. The ECU 100 energizes the solenoid 270 with the initial ON-time $T_{ON}$11 and the frequency F11. The routine 310 then returns back to the step S11 and repeats the step S11.

If the determination at the step S15 is affirmative, the routine 310 proceeds to a step S17. FIG. 9 also illustrates that an amount of the lubricant amount can be increased if the frequency is adjusted with an adjustment coefficient $K_T$ (>1) when the lubricant temperature is lower than 0° C. The ECU 100 adjusts the frequency F using a control map of FIG. 10 that includes the adjustment coefficient $K_T$ corresponding to the temperature. For example, if the temperature is t1 (<0° C.), the adjustment coefficient $K_T$ is $K_T$1 (>1).

The routine 310 proceeds to a step S18 and the ECU 100 energizes the solenoid 270 with the initial ON-time $T_{ON}$11 and the adjusted frequency F (=F11×$K_T$1). The routine 310 then returns back to the step S11 and repeats the step S11.

In the second control method, the frequency of the periodic pressurization by the lubrication pump 158 is adjusted to be higher than that under the normal control when the lubricant temperature is lower than the preset temperature, for example, 0° C. Thus, a sufficient amount of the lubricant can be injected by the lubricant pump 158 even though the pumping piston 246 is inhibited from moving over its full stroke S in the cavity 244.

Third Control Method

With reference to FIGS. 5 and 9–12, a third control method of the lubrication pump 158 will be described.

The third control method can be stored as a control routine 320 (FIG. 11) in one of the memories of the ECU 100. The ECU 100, using the control routine 320, controls the lubrication pump 158 differently from a normal control if a lubricant temperature is lower than a preset temperature, like the second control method; however, in addition to the second control method, the ECU 100 also shortens the ON-time of the solenoid 270 under the condition that the lubricant temperature is lower than the preset temperature.

Figure 11:
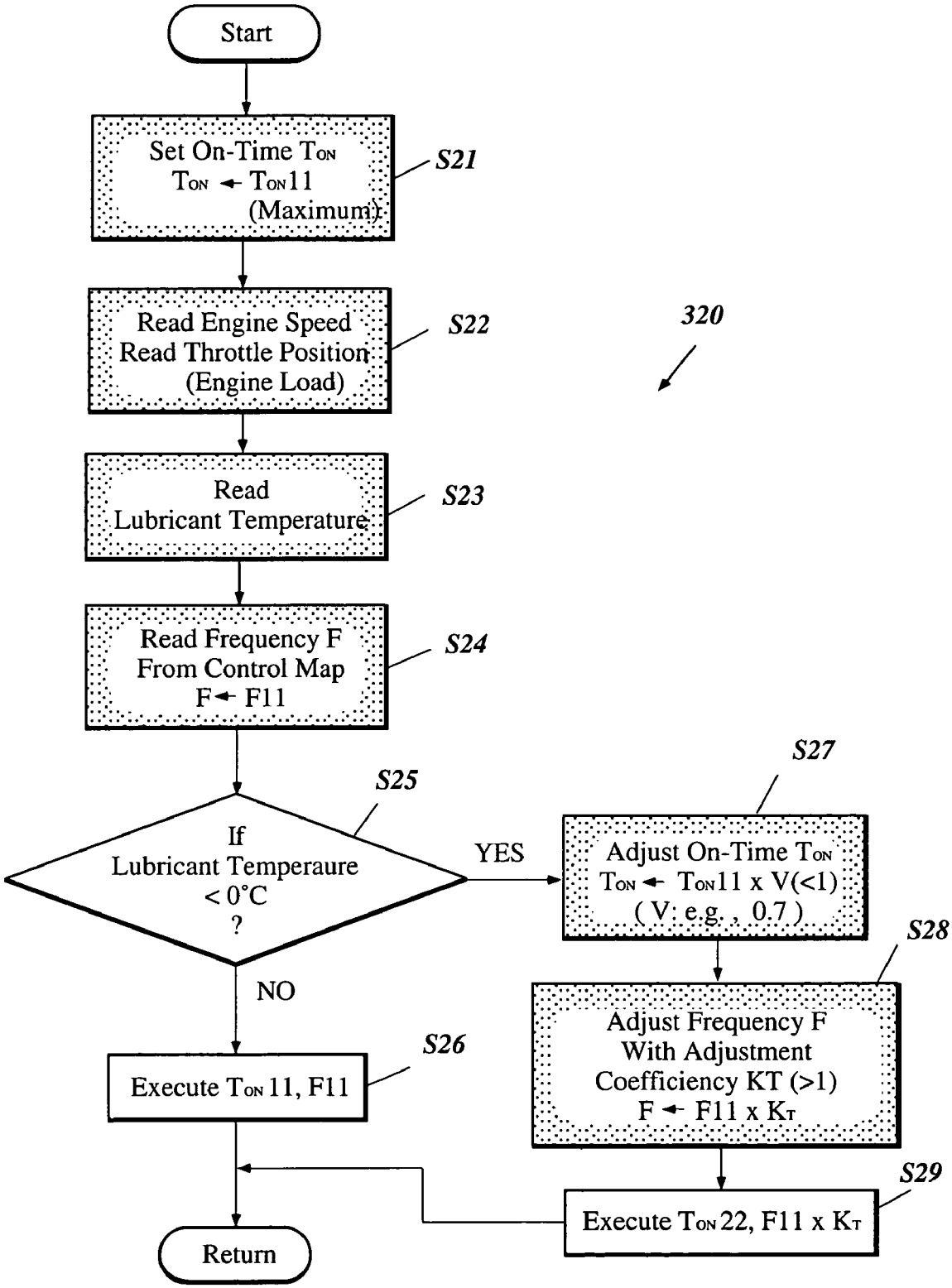
FIG. 11 is a flow chart illustrating another modified control routine for operating a lubrication pump in accordance with a further embodiment of at least one of the inventions disclosed herein.

With initial reference to FIG. 11, the control routine 320 starts and proceeds to a step S21. The ECU 100, at the step S21, sets an ON-time $T_{ON}$11 as an initial ON-time. The ON-time $T_{ON}$11 is a constant period of time and also is the maximum period of time.

The routine 320 then goes to a step S22 and the ECU 100 reads an engine speed sensed by the engine speed sensor 190 (e.g., the sensor 190 and part of the ECU 100, as described above), and a throttle position that represents an engine load. The routine 320 moves to a step S23.

The ECU 100, at the step S23, reads a temperature of the lubricant at the lubrication pump 158 and goes to a step S24.

The ECU 100, at the step S24, reads frequency F of the periodic pressurization corresponding to the engine speed and the engine load from a control map of FIG. 5 and sets the frequency F as an initial frequency. Similarly to the first and second control methods, if the engine speed is E1 and the engine load is L1, then the frequency is F11, for example. The routine 320 then goes to a step S25.

At the step S25, the ECU 100 determines whether the lubricant temperature is lower than a preset temperature. In this control method, the preset temperature is zero degree Celsius (0° C.).

If the determination at the step S25 is negative, the routine 320 proceeds to a step S26. The ECU 100 energizes the solenoid 270 with the initial ON-time $T_{ON}$11 and the frequency F11. The routine 320 then returns back to the step S21 and repeats the step S21.

If the determination at the step S25 is affirmative, the routine 320 proceeds to a step S27 and the ECU 100 adjusts the initial ON-time $T_{ON}$11. That is, the ECU 100 shortens the initial ON-time $T_{ON}$11.

Figure 12:
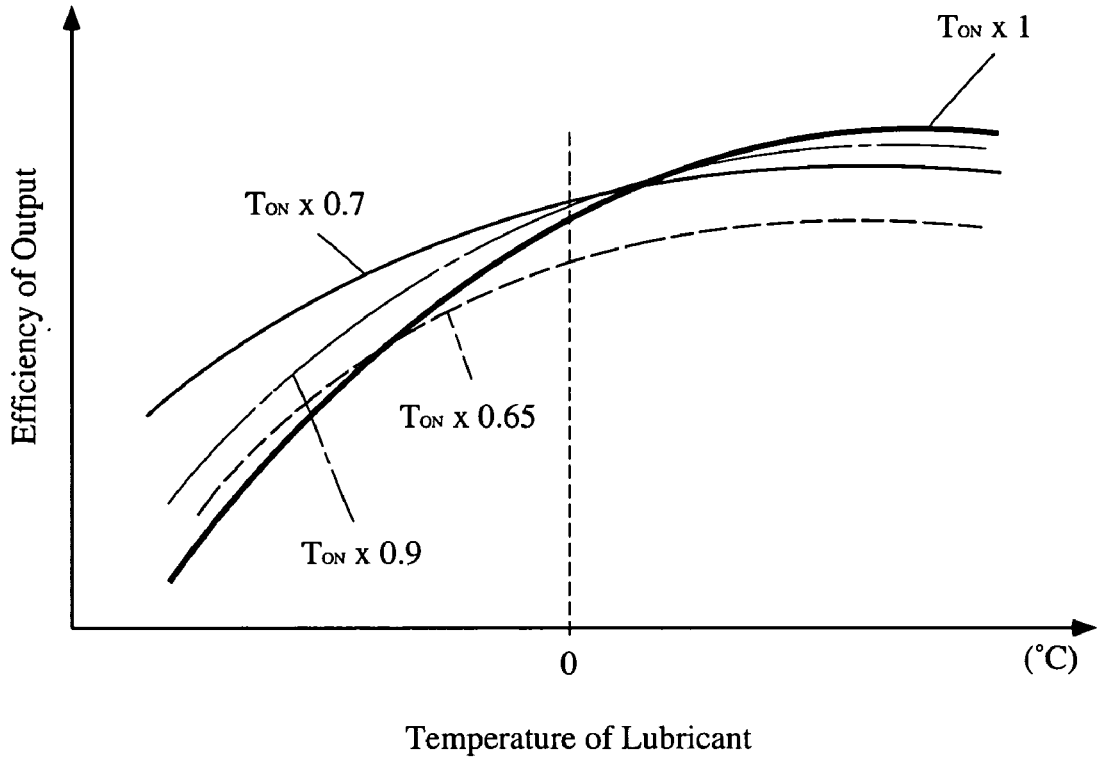
FIG. 12 is a chart illustrating relationships between the temperature of the lubricant and an output efficiency of the lubrication pump when the ON-time of the solenoid is changed with several coefficients.
Figure 13:
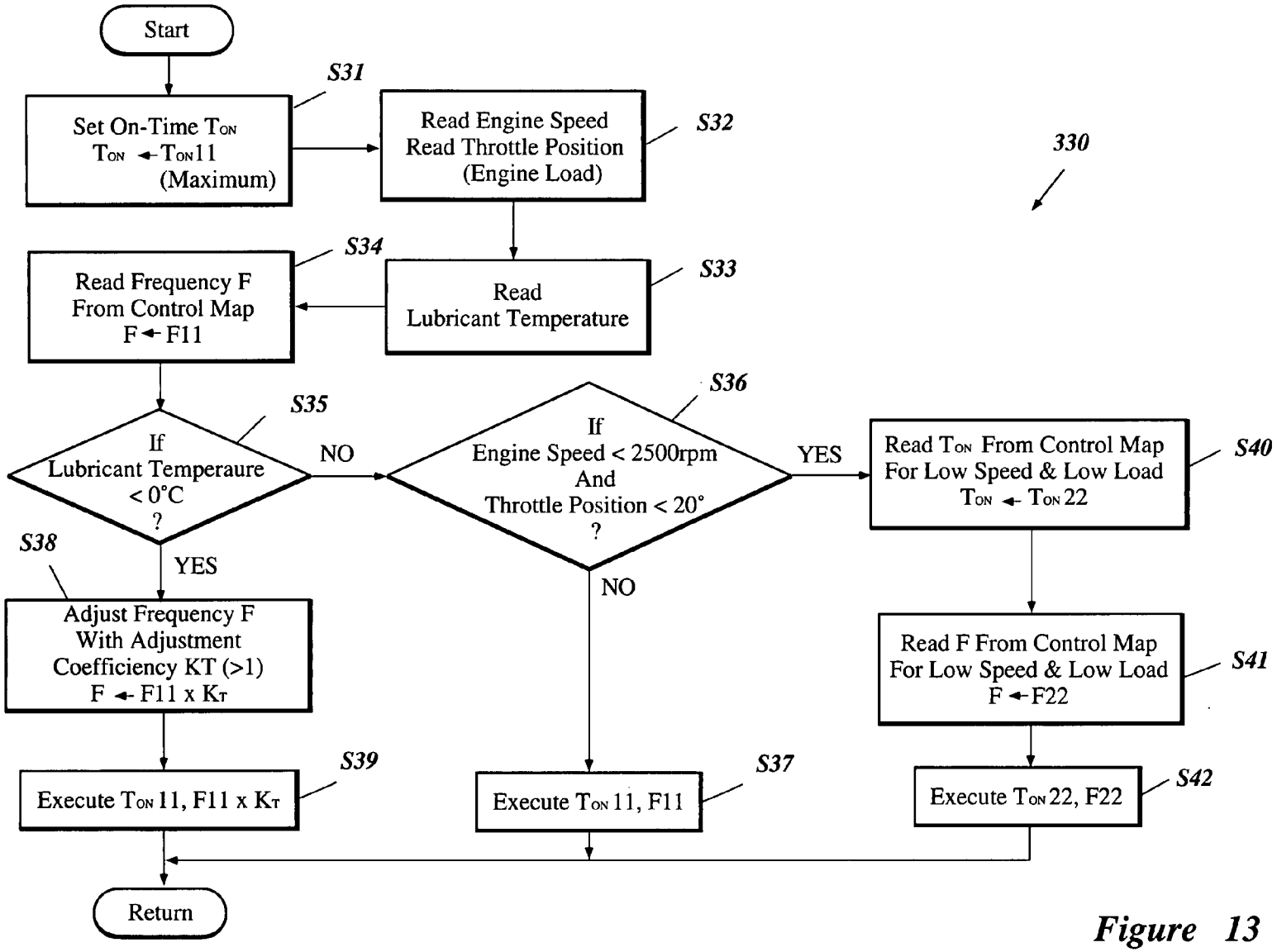
FIG. 13 is a flow chart illustrating a further modified control routine for operating a lubrication pump in accordance with a still further embodiment of at least one of inventions disclosed herein.

With reference to FIG. 12, when the lubricant temperature is higher than about 0° C., an output efficiency of the lubrication pump 158 is the largest if the ON-time $T_{ON}$ is set at the maximum period time. In other words, the shorter the ON-time $T_{ON}$, the smaller the output efficiency when the lubricant temperature is generally higher than 0° C.

On the other hand, however, when the lubricant temperature is lower than about 0° C., setting the ON-time $T_{ON}$ to the maximum period time (100%) does not result the largest output efficiency. A lower percentage such as, for example, 90% or 70% of the maximum ON-time $T_{ON}$ can bring a better output efficiency rather than the maximum ON-time $T_{ON}$. Experiments conducted by the inventor reveal that approximately 70% of the maximum ON-time $T_{ON}$ is the best, approximately 90% of the maximum ON-time $T_{ON}$ is better than the maximum (100%) ON-time $T_{ON}$, and approximately 65% of the maximum ON-time $T_{ON}$ is worse than the 90% of the maximum ON-time $T_{ON}$ but is slightly better than the maximum (100%) ON-time $T_{ON}$, although the percentages can slightly vary depending on conditions of the lubricant.

The ECU 100 thus adjusts the initial ON-time $T_{ON}$11 by multiplying a coefficient V (<1) at the step S27. The coefficient V preferably is 0.7. That is, the ECU 100 may allow the pumping piston 246 to move for 70% of the full stroke at a later step.

The routine 320 then proceeds to a step S28 and the ECU 100 adjusts the frequency F using the control map of FIG. 10 that includes the adjustment coefficient $K_T$ corresponding to the temperature. For example, if the temperature is t1 (<0° C.), the adjustment coefficient $K_T$ is $K_T$1 (>1).

The routine 320 goes to a step S29 and the ECU 100 energizes the solenoid 270 with the adjusted ON-time $T_{ON}$ (=$T_{ON}$11×0.7) and the adjusted frequency F (=F11×$K_T$1). The routine 320 then returns back to the step S21 and repeats the step S21.

In the third control method, the ON-time of the solenoid 270 is adjusted to be shorter than the maximum ON-time, preferably 70% of the maximum ON-time, and the frequency of the periodic pressurization by the lubrication pump 158 is adjusted to be higher than that under the normal control, both when the lubricant temperature is lower than the preset temperature, for example, 0° C. Thus, the output efficiency of the lubrication pump 158, while the lubricant temperature being below the preset temperature, is extremely improved and a sufficient amount of the lubricant can be injected by the lubricant pump 158 even though the pumping piston 246 does not fully move in the cavity 244. In addition, the power that energizes the solenoid 270 at a lubricant temperature lower than the preset temperature can be saved.

Fourth Control Method

With reference to FIGS. 4–7, 10 and 13, a fourth control method of the lubrication pump 158 is described below.

The fourth control method can be stored as a control routine 330 (FIG. 13) in one of the memories of the ECU 100. The control routine 330 preferably is made by combining the first control method and the second control method.

The control routine 330 starts and proceeds to a step S31. The ECU 100, at the step S31, sets an ON-time $TO_N$11 as an initial ON-time $T_{ON}$. As described above, the ON-time $T_{ON}$11 is a constant period of time and also is the maximum period of time.

The routine 330 then goes to a step S32 and the ECU 100 reads an engine speed sensed by the engine speed sensor 190 (e.g., the sensor 190 and part of the ECU 100, as described above), and a throttle position that represents an engine load. The routine 330 then moves to a step S33.

The ECU 100, at the step S33, reads a temperature of the lubricant at the lubrication pump 158 and goes to a step S34. At the step S34, the ECU 100 reads a frequency F of the periodic pressurization corresponding to the engine speed and the engine load from a control map of FIG. 5 and sets the frequency F as an initial frequency. For example, if the engine speed is E1 and the engine load is L1, then the frequency is F11, as described above. The routine 330 then goes to a step S35.

At the step S35, the ECU 100 determines whether the lubricant temperature is lower than a preset temperature. Like in the second control method, the preset temperature is 0° C. for the same reason described above.

If the determination at the step S35 is negative, the routine 330 proceeds to a step S36. The ECU 100 determines whether the engine speed is less than a preset engine speed and the engine load is less than a preset engine load. Like the first control method, the preset engine speed is 2,500 rpm and the preset engine load is the engine load that corresponds to the throttle position of 20 degrees.

If the determination at the step S36 is negative, the routine 330 proceeds to a step S37 and the ECU 100 energizes the solenoid 270 with the initial ON-time $T_{ON}$11 and the initial frequency F11. The routine 330 then returns back to the step S31 to repeat the step S31.

If the determination at the step S35 is affirmative, the routine 330 proceeds to a step S38 and the ECU 100 adjusts the frequency F using the control map of FIG. 10. For example, if the temperature is t1 (<0° C.), the adjustment coefficient $K_T$ is $K_T$1 (>1), as described above.

The routine 330 proceeds to a step S39 and the ECU 100 energizes the solenoid 270 with the initial ON-time $T_{ON}$11 and with the adjusted frequency F (=F11×$K_T$1). The routine 330 then returns back to the step S31 and repeats the step S31.

If the determination at the step S36 is affirmative, the ECU 100 recognizes that both the engine speed and the engine load fall in a low range that is indicated by the hatched area of FIG. 4 and the routine 330 proceeds to a step S40 to set an ON-time $T_{ON}$ that varies corresponding to the engine speed and the engine load. That is, the ECU 100, at the step S40, reads an ON-time $T_{ON}$ corresponding to the engine speed and the engine load in referring to the control map of FIG. 6. For example, if the engine speed is E2 and the engine load is L2, then the ON-time is $T_{ON}$22, as described above. The ON-time for the low engine speed and low engine load is shorter than the initial ON-time, i.e., the maximum ON-time (e.g., $T_{ON}$22<$T_{ON}$11). Then, the routine 330 proceeds to a step S41.

At the step S41, the ECU 100 reads a frequency corresponding to the engine speed and the engine load in the control map of FIG. 7. For example, if the engine speed is E2 and the engine load is L2, then the frequency is F22, as described above. Like in the first control method, the frequency for the low engine speed and low engine load is higher than a frequency that could be set if the ON-time is the maximum (i.e., the latter frequency could be set using the hatching area of FIG. 5).

The routine 330 then proceeds to a step S42 and the ECU 100 energizes the solenoid 270 with the ON-time $T_{ON}$22 and the frequency F22. The routine 330 then returns back to the step S3 to repeat the step S31.

As thus described, the fourth control method is made by combining the first and second control methods. Thus, the fourth control methods can provide both the advantages of the first and second control methods.

Fifth Control Method

Figure 14:
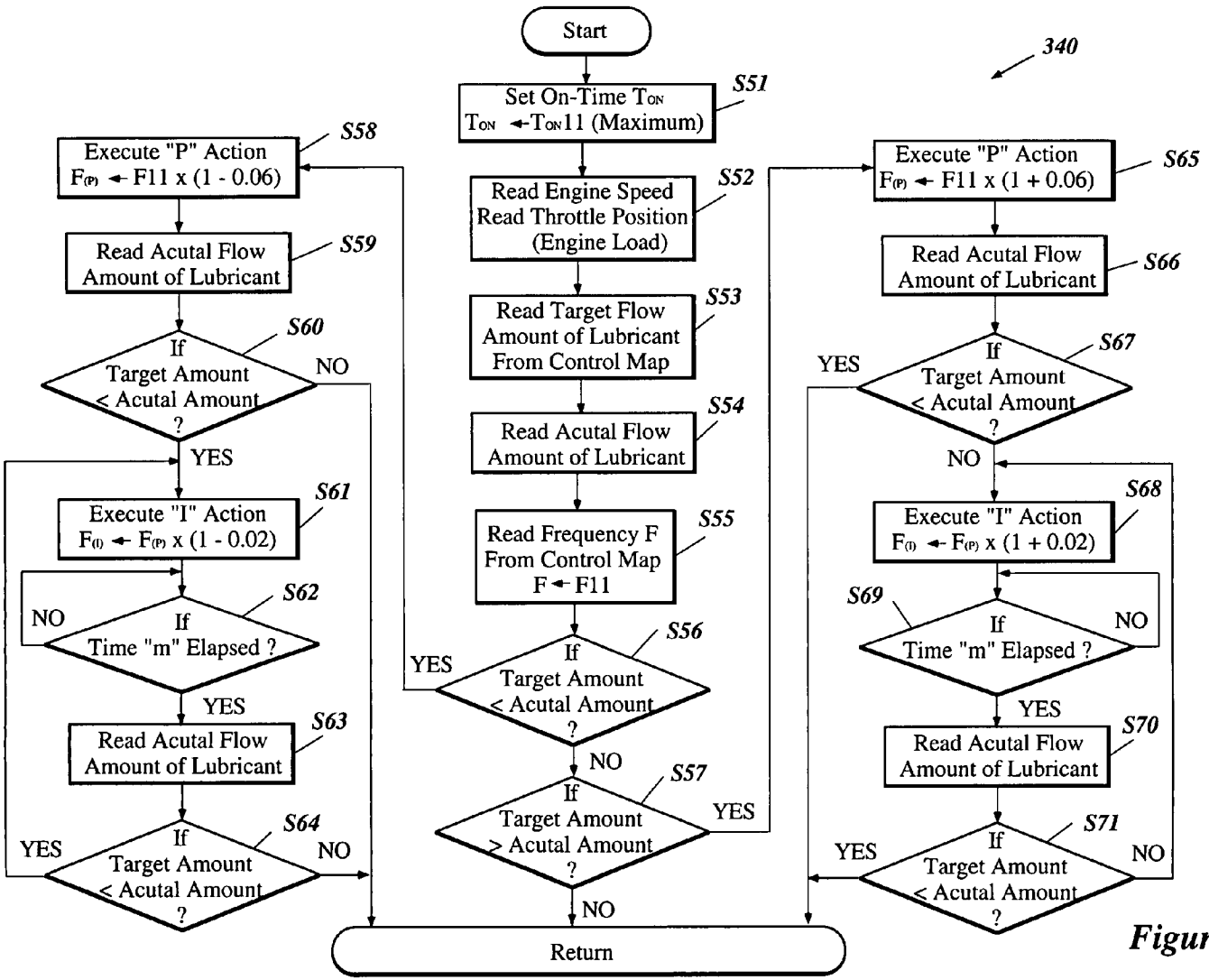
FIG. 14 is a flow chart illustrating a still further modified control routine for operating a lubrication pump in accordance with an yet further embodiment of at least one of inventions disclosed herein.
Figure 15:
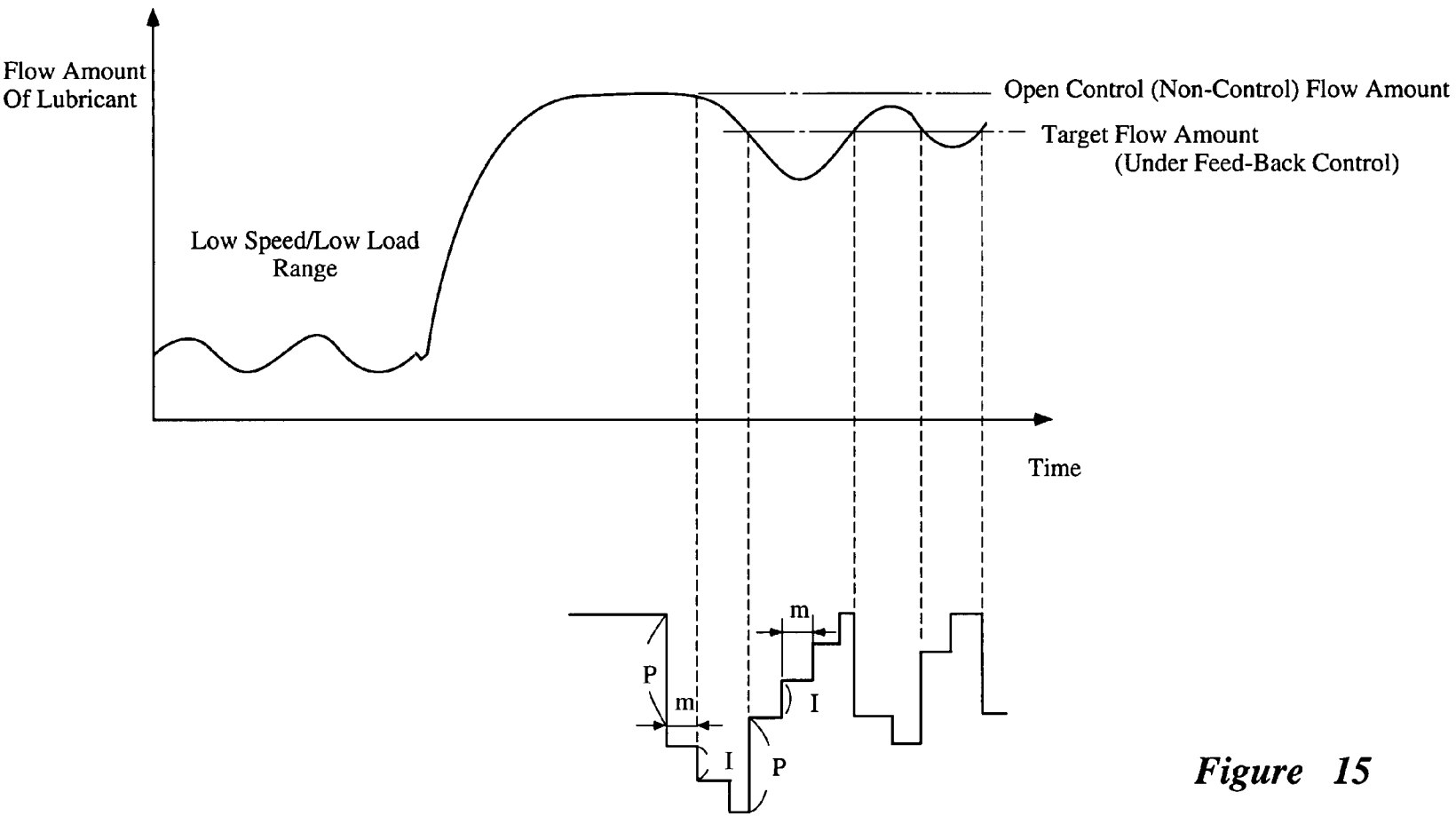
FIG. 15 is a chart illustrating a change in a flow amount of the lubricant versus time and a change of a control amount in a feed-back control that converges an actual amount to a target amount.

With reference to FIGS. 5, 14 and 15, a fifth control method of the lubrication pump 158 will be described.

The fifth control method can be stored as a control routine 340 (FIG. 14) in one of the memories of the ECU 100. The ECU 100 practices an improved feedback control on the lubrication pump 158 using the control routine 340.

With initial reference to FIG. 15, a flow amount of the lubricant is small in a low engine speed and low engine load range. The lubricant flow amount drastically increases when the engine 36 operates in a higher engine speed range or in a higher engine load range and settles at an open control (non-control) amount unless the feedback control is practiced. In order to bring the actual flow amount to a target flow amount, the ECU 100 practices the improved feedback control. Initially, the ECU 100 attempts a proportional action P that gives a relatively large increase or decrease control amount (adjustment amount) to the frequency of the periodic pressurization. If the actual flow amount is still larger or smaller than the target flow amount, then the ECU 100 attempts a plurality of integral actions I each gives a relatively small increase or decrease control amount (adjustment amount) to the frequency of the periodic pressurization. Each integral action I is repeated with intervals m. Thus, the actual flow amount can approach the target flow amount.

With reference to FIG. 14, the control routine 340 starts and proceeds to a step S51. The ECU 100, at the step S51, sets an ON-time $T_{ON}$11 as an initial ON-time $T_{ON}$. The ON-time $T_{ON}$11 is a constant period of time and also is the maximum period of time, as described above. The routine 340 then goes to a step S52 and the ECU 100 reads an engine speed sensed by the engine speed sensor 190 (e.g., the sensor 190 and part of the ECU 100, as described above), and a throttle position that represents an engine load.

The routine 340 moves to a step S53 and the ECU 100 reads a target amount of the lubricant from a control map (not shown).

The routine 340 then goes to a step S54 and the ECU 100 reads an actual flow amount of the lubricant from an output of the flow amount sensor 200. Then the routine 340 goes to a step S55.

The ECU 100, at the step S55, reads a frequency F of the periodic pressurization corresponding to the engine speed and the engine load from a control map of FIG. 5 and sets the frequency F as an initial frequency. For example, if the engine speed is E1 and the engine load is L1, then the frequency is F11, as described above. The routine 340 then goes to a step S56.

At the step S56, the ECU 100 determines whether the actual flow amount is greater than the target flow amount.

If the determination at the step S56 is negative, the routine 340 goes to a step S57 and determines whether the actual flow amount is smaller than the target flow amount.

If the determination at the step S57 is negative, the actual flow amount is equal to the target flow amount and thus, the routine 340 returns back to the step S51 and repeats the step S51.

If the determination at the step 56 is affirmative and the actual flow amount is greater than the target flow amount, the routine 340 goes to a step S58 and the ECU 100 executes the proportional action P. Preferably, the ECU 100 multiplies the frequency F11 by an adjustment amount (1−0.06) and energizes the solenoid 270 with the frequency [F11×(1−0.06)]. That is, the ECU 100 operates the lubrication pump 158 with the frequency which is 6% lower than the initial frequency F11.

The routine 340 moves to a step S59 and reads an actual flow amount. The routine 340 then goes to a step S60 and the ECU 100 determines whether the actual amount is greater than the target flow amount.

If the determination at the step S60 is negative, the routine 340 returns back to the step S51 and repeats the step S51.

If the determination at the step S60 is affirmative, the routine 340 moves to a step S61 and the ECU 100 executes the integral action I. Preferably, the ECU 100 multiples the frequency [F11×(1−0.06)] by an adjustment amount (1−0.02) and energizes the solenoid 270 with the adjusted frequency. That is, the ECU 100 operates the lubrication pump 158 with the frequency which is further 2% lower than the previously frequency F11. The routine 340 then goes to a step S62 and the ECU 100 determines whether a period of time m has elapsed.

If the determination at the step S62 is negative, the routine 340 returns to the step S62 and repeats the step S62.

If the determination at the step S62 is affirmative, the routine 340 moves to a step S63 and the ECU 100 again reads an actual flow amount. The routine 340 then goes to a step S64 and the ECU 100 determines whether the actual amount at this moment is greater than the target flow amount.

If the determination at the step S64 is negative, the routine 340 returns back to the step S51 and repeats the step S51.

If the determination at the step S64 is affirmative, the routine 340 returns to the step S61 and repeats the step S61.

Theoretically, the integral actions I can endlessly repeat. However, the integral actions I would normally repeat several times such as, for example, twice as shown in FIG. 15.

With continued reference to FIG. 14, if the determination at the step S57 is affirmative and the actual flow amount is smaller than the target flow amount, the routine 340 goes to a step S65 and the ECU 100 executes the proportional action P. Preferably, the ECU 100 multiplies the frequency F11 by an adjustment amount (1+0.06) and energizes the solenoid 270 with the frequency [F11×(1+0.06)]. That is, the ECU 100 operates the lubrication pump 158 with the frequency which is 6% higher than the initial frequency F11.

The routine 340 moves to a step S66 and reads an actual flow amount. The routine 340 then goes to a step S67 and the ECU 100 determines whether the actual amount is greater than the target flow amount.

If the determination at the step S67 is affirmative, the routine 340 returns back to the step S51 and repeats the step S51.

If the determination at the step S67 is negative, the routine 340 moves to a step S68 and the ECU 100 executes the integral action I. Preferably, the ECU 100 multiplies the frequency [F11×(1+0.06)] by an adjustment amount (1+0.02) and energizes the solenoid 270 with the adjusted frequency. That is, the ECU 100 operates the lubrication pump 158 with the frequency which is further 2% higher than the previously frequency F11. The routine 340 then goes to a step S69 and the ECU 100 determines whether a period of time m has lapsed.

If the determination at the step S69 is negative, the routine 340 returns to the step S69 and repeats the step S69.

If the determination at the step S69 is affirmative, the routine 340 moves to a step S70 and the ECU 100 again reads an actual flow amount. The routine 340 then goes to a step S71 and the ECU 100 determines whether the actual amount at this moment is greater than the target flow amount.

If the determination at the step S71 is affirmative, the routine 340 returns back to the step S51 and repeats the step S51.

If the determination at the step S71 is negative, the routine 340 returns to the step 69 and repeats the step S69.

Theoretically, the integral actions I can endlessly repeat. Actually, however, the integral actions I repeat several times such as, for example, three times as shown in F*ig*. 15.

Additionally, the ECU 100 can determines whether a difference between the actual flow amount and the target flow amount is greater than a preset difference. If the determination is affirmative, an abnormal condition such as, for example, a malfunction of the lubrication pump 158 has occurred with the lubrication system 156. The ECU 100 preferably stores this event in one of the memories to use for control of the engine 36 such as, for example, for slowing down the engine speed or for stopping the engine operation. Otherwise, the ECU 100 can send a warning signal to the indicator 230 to indicate the abnormal condition of the lubrication system 156. Additionally or alternatively, the ECU 100 can send the warning signal to a buzzer to warn with sound. The operator thus can easily be aware of the abnormal condition.

As thus described, the ECU applies the feedback control (PI control) in the fifth control method to control the lubrication pump. The feedback control is particularly suitable for an engine assembled with various components and members that have tolerances, lubricated by an unspecified lubricant (e.g., having different viscosity) and used under unspecified conditions (e.g., under a different lubricant temperature). In addition, an actual lubricant amount at any moment can approach the target lubricant amount without delay in the feedback control because initially the proportional action is applied and then several integral actions are applied.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while several variations of the invention have been shown and described in detail, other modifications, which are within the scope of this invention, will be readily apparent to those of skill in the art based upon this disclosure. It is also contemplated that various combination or sub-combinations of the specific features and aspects of the embodiments may be made and still fall within the scope of the invention. It should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. An internal combustion engine comprising a lubrication system arranged to lubricate at least a portion of the engine with lubricant, the lubrication system having a lubrication pump that periodically pressurizes the lubricant toward the portion of the engine, at least one sensor configured to sense either an engine speed or an engine load of the engine, and a control device configured to control the lubrication pump, the control device is also configured to determine a frequency of periodic pressurization based upon a signal from the sensor, the control device configured to set a pressurizing time of the lubrication pump to a period of time shorter than the maximum period of time that is capable to be set for the lubrication pump at the determined frequency, when the signal from the sensor indicates that the engine speed is within a range of engine speeds less than a preset engine speed or the engine load is within a range of engine loads less than a preset engine load.

2. The engine as set forth in claim 1, wherein the control device has a control reference correlating frequency and engine speed or engine load, the control device being configured to determine the frequency by referring the control reference.

3. The engine as set forth in claim 1, wherein the control device is configured to set the pressurizing time to a maximum period of time when the signal from the sensor indicates that the engine speed or the engine load is greater than a preset engine speed or engine load.

4. The engine as set forth in claim 1 comprising an engine speed sensor and an engine load sensor, the control device being configured to set the pressurizing time to the shorter time when a signal from the engine speed sensor indicates that the engine speed is less than a preset engine speed and a signal from the engine load sensor indicates that the engine load is less than a preset engine load.

5. The engine as set forth in claim 4, wherein the control device is configured to set the pressurizing time generally to the maximum period of time when either a signal from the engine speed sensor indicates that the engine speed is greater than a preset engine speed or a signal from the engine load sensor indicates that the engine load is greater than a preset engine load.

6. The engine as set forth in claim 4 additionally comprising an engine body, and a movable member movable relative to the engine body, the engine speed sensor senses a moving speed of the movable member.

7. The engine as set forth in claim 6, wherein the movable member is a crankshaft of the engine.

8. The engine as set forth in claim 4 additionally comprising an engine body, a movable member movable relative to the engine body, the engine body and the movable member defining a combustion chamber, and an air intake system arranged to introduce air into the combustion chamber, the air intake system comprising a throttle valve configured to regulate an amount of the air, the engine load sensor being configured to sense a position of the throttle valve.

9. The engine as set forth in claim 8, wherein the movable member is a piston of the engine.

10. The engine as set forth in claim 1, wherein the lubrication pump comprises a pumping piston, a plunger coupled with the pumping piston, and an electromagnetic solenoid configured to actuate the plunger, the control device being configured to control the solenoid to selectively actuate or release the plunger such that the pumping piston periodically pressurizes the lubricant, and wherein the pressurizing time of the lubrication pump is a time period in which the solenoid actuates the plunger.

11. The engine as set forth in claim 10, wherein the maximum period of time is a time period in which the pumping piston moves over a maximum stroke.

12. The engine as set forth in claim 1, wherein the control device includes a control reference correlating a pressurizing time of the lubrication pump and the engine speed less than the preset engine speed or the engine load less than the preset engine load, the control device being configured to set the pressurizing time based upon the signal from the sensor by referring the control reference.

13. The engine as set forth in claim 1, wherein the control device is configured to adjust the frequency such that the adjusted frequency is higher than the determined frequency, when the signal from the sensor indicates that the engine speed is less than the preset speed or the engine load is less than the preset engine load.

14. The engine as set forth in claim 13, wherein the control device includes a control reference correlating a frequency of the periodic pressurization and an engine speed less than the preset engine speed or an engine load less than the preset engine load, the control device being configured to determine the frequency based upon a signal from the sensor by referring the control reference when the signal from the sensor indicates that the engine speed is less than the preset speed or the engine load is less than the preset engine load.

15. The engine as set forth in claim 1 additionally comprising an engine body, a movable member movable relative to the engine body, the engine body and the movable member defining a combustion chamber, and an air intake system arranged to introduce air into the combustion chamber, the lubrication pump being configured to inject the lubricant into the air intake system.

16. The engine as set forth in claim 1, wherein the engine is configured to operate on a two-cycle combustion principle.

17. The engine as set forth in claim 1, wherein the maximum period of time is a minimum amount of time required for the lubrication pump to complete one stroke.

18. An internal combustion engine comprising a lubrication system arranged to lubricate at least a portion of the engine with lubricant, the lubrication system having a lubrication pump configured to periodically pressurize the lubricant toward the portion of the engine, a sensor configured to sense either an engine speed or an engine load of the engine, and a control device configured to control the lubrication pump, the control device configured to determine a first frequency of a periodic pressurization based upon a signal from the sensor, the control device configured to adjust the frequency such that the adjusted frequency is higher than the first frequency, when a signal from the sensor indicates that the engine speed is within a range of engine speeds less than a preset engine speed or the engine load is within a range of engine loads less than a preset engine load.

19. The engine as set forth in claim 18, wherein the control device has a control reference correlating frequency and engine speed or the engine load, the control device being configured to determine the first frequency by referring the control reference.

20. An internal combustion engine comprising a lubrication system arranged to lubricate at least a portion of the engine with lubricant, the lubrication system having a lubrication pump that periodically pressurizes lubricant toward the portion of the engine, a first sensor configured to sense an operational condition of the engine, a second sensor configured to sense a temperature of the lubricant, and a control device configured to control the lubrication pump, the control device configured to determine a first frequency based upon a signal from the first sensor, the control device determining a second frequency of the periodic pressurization that is higher than the first frequency when a signal from the second sensor indicates that the temperature of the lubricant is less than a preset temperature, wherein the control device is configured to set a pressurizing time of the lubrication pump to a period of time shorter than the maximum period of time that can be set for the lubrication pump at the frequency determined in referring to the control reference, when the signal from the second sensor indicates that the temperature of the lubricant is less than the preset temperature.

21. The engine as set forth in claim 20, wherein the control device includes a control reference correlating frequency and the operational condition of the engine, the control device being configured to determine at least one of ihe first and second frequencies by referring the control reference.

22. The engine as set forth in claim 20, wherein the control device is configured to set the pressuring time to the maximum period of time when the signal from the second sensor indicates that the temperature of the lubricant is greater than the preset temperature, wherein the maximum period of time corresponds to a time sufficient for causing a piston of the lubrication pump to complete an entire stroke.

23. The engine as set forth in claim 20, wherein the maximum period of time is a minimum amount of time required for the lubrication pump to complete one stroke.

24. An internal combustion engine comprising a lubrication system arranged to lubricate at least a portion of the engine with lubricant, the lubrication system having a lubrication pump that periodically pressurizes the lubricant toward the portion of the engine, a first sensor configured to sense either an engine speed or an engine load of the engine, a second sensor configured to sense a temperature of the lubricant, and a control device configured to control the lubrication pump, the control device configured to determine a first frequency of periodic pressurization based upon a signal from the first sensor, the control device also being configured to adjust the first frequency such that the adjusted first frequency is higher than the first frequency and to adjust a periodic pressurization time of the lubricant pump to a period of time shorter than that required for the pump to complete a full stroke when the control device receives a signal from at least one of the first sensor indicating that the engine speed is less than a preset engine speed or the engine load is less than a preset engine load, and the second sensor indicating that the temperature of the lubricant is less than a preset temperature.

25. The engine as set forth in claim 24, wherein the control device includes a control reference correlating frequency and the engine speed or the engine load, the control device being configured to determine the first frequency by referring the control reference.

26. An internal combustion engine comprising a lubrication system arranged to lubricate at least a portion of the engine with lubricant, the lubrication system having a lubrication pump that periodically pressurizes the lubricant toward the portion of the engine, a first sensor configured to sense an operational condition of the engine, a second sensor configured to sense an amount of lubricant delivered by the lubrication pump, and a control device configured to control the lubrication pump, the control device being configured to determine a frequency of periodic pressurization based upon a signal from the first sensor, wherein higher frequencies correspond to greater amounts of lubricant, the control device also being configured to determine a target amount of lubricant to be delivered by the lubricant pump based upon a signal from the first sensor, the control device further being configured to adjust the frequency with a first adjustment value when the sensed amount differs from the target amount, the control device being configured to adjust the frequency with a second adjustment value when the sensed amount differs from the target amount after the frequency has been adjusted by the first value, the first adjustment amount being greater than the second adjustment amount.

27. The engine as set forth in claim 26, wherein the control device is configured to determine whether a difference between the target amount and the sensed amount is greater than a preset difference, the control device being configured to store the difference when the control device determines that the difference between the target amount and the actual amount is greater than the preset difference.

28. The engine as set forth in claim 26 additionally comprising a warning device that configured to output a warning, the control device being configured to determine whether a difference between the target amount and the sensed amount is greater than a preset difference, the control device being configured to actuate the warning device when the control device determines that the difference between the target amount and the sensed amount is greater than the preset difference.

29. The engine as set forth in claim 26, wherein the control devices has a control reference correlating target amounts of lubricant and operational condition of the engine, the control device being configured to determine the target amount by referring to the control reference.

30. The engine as set forth in claim 26, wherein the control device has a control reference correlating frequencies and the operational conditions of the engine, the control device being configured to determine the frequency of the periodic pressurization by referring the control reference.

31. A method for controlling a lubrication system that lubricates at least a portion of an engine, the lubrication system having a lubrication pump that periodically pressurizes the lubricant toward the portion of the engine, the method comprising sensing at least one of an engine speed and an engine load of the engine, determining a frequency of the periodic pressurization based upon the engine speed or the engine load, determining whether the engine speed is within a range of engine speeds less than a preset engine speed or the engine load is within a range of engine loads less than a preset engine load, and setting a pressurizing time of the lubrication pump to a period of time shorter than the maximum period of time that is capable to be set for the lubrication pump, when the determination of the engine speed or the engine load is affirmative.

32. The method as set forth in claim 31 additionally comprising setting the pressurizing time generally to the maximum period of time when the determination of the engine speed or the engine load is negative, wherein the maximum period of time is a time sufficient for a piston of the lubrication pump to move over an entire stoke.

33. The method as set forth in claim 31 additionally comprising adjusting the frequency to a higher frequency than the determined frequency.

34. The method as set forth in claim 31, wherein the maximum period of time is a minimum amount of time required for the lubrication pump to complete one stroke.

35. A method for controlling a lubrication system that lubricates at least a portion of an engine, the lubrication system having a lubrication pump that periodically pressurizes the lubricant toward the portion of the engine, the method comprising sensing at least one of an engine speed and an engine load of the engine, determining a frequency of the periodic pressurization based upon at least one of the engine speed and the engine load, determining whether the engine speed is within a range of engine speeds less than a preset engine speed or the engine load is within a range of engine loads less than a preset engine load, and increasing the frequency when the determination of the engine speed or the engine load is affirmative.

36. A method for controlling a lubrication system that lubricates at least a portion of an engine, the lubrication system having a lubrication pump that periodically pressurizes the lubricant toward the portion of the engine, the method comprising sensing an operational condition of the engine, sensing a temperature of the lubricant, determining a frequency of periodic pressurization based upon the operational condition of the engine, determining whether the temperature of the lubricant is less than a preset temperature, increasing the frequency when the determination of the temperature is affirmative, and decreasing a duration of the periodic pressurization of the lubricant pump to a time period less than a minimum time reciuired for the pump to complete one stroke.

37. A method for controlling a lubrication system that lubricates at least a portion of an engine, the lubrication system having a lubrication pump that periodically pressurizes the lubricant toward the portion of the engine, the method comprising sensing at least one of an engine speed and an engine load of the engine, sensing a temperature of the lubricant, determining a frequency of periodic pressurization based upon the engine speed or the engine load, determining whether the engine speed is less than a preset engine speed or the engine load is less than the preset engine load, determining whether the temperature of the lubricant is less than a preset temperature, increasing the frequency when the determination of at least one of the engine speed, the engine load, and the temperature is affirmative, and decreasing a duration of the periodic pressurization of the lubricant pump to a time period less than a minimum time required for the pump to complete one stroke.

38. A method for controlling a lubrication system that lubricates at least a portion of an engine, the lubrication system having a lubrication pump that periodically pressurizes the lubricant toward the portion of the engine, the method comprising sensing an operational condition of the engine, sensing an amount of the lubricant discharged from the lubrication pump, determining a frequency of periodic pressurization based upon the operational condition of the engine, wherein higher frequencies correspond to greater amounts of lubricant, determining a target amount of the lubricant based upon the operational condition of the engine, determining whether the sensed amount differs from the target amount, adjusting the frequency with a first adjustment value when the determination of the difference is affirmative, determining whether the actual amount differs from the target amount after the frequency has been adjusted with the first adjustment value, and adjusting the frequency with a second adjustment value when the second determination of the difference is affirmative, the first adjustment amount being greater than the second adjustment amount.

39. The method as set forth in claim 38 additionally comprising determining whether a difference between the target amount and the sensed amount is greater than a preset difference, and storing the difference when the determination of the difference magnitude is affirmative.

40. The method as set forth in claim 38 additionally comprising determining whether a difference between the target amount and the sensed amount is greater than a preset difference, and actuating a warning device when the determination of the difference magnitude is affirmative.

41. An internal combustion engine comprising:

a lubrication system configured to lubricate at least a portion of the engine with a lubricant, the lubrication system including a lubrication pump that periodically pressurizes the lubricant toward the portion of the engine;

at least one sensor configured to sense at least one operational condition of the engine, the at least one operational condition of the engine comprising a speed of the engine, a load on the engine, a temperature of the lubricant, and an actual flow amount of the lubricant; and a control device configured to control the lubrication pump, to determine a frequency of the periodic pressurization based upon a signal from the at least one sensor, and configured to set a pressurizing time of the lubrication pump to a period of time shorter than a maximum period of time to be set for the lubrication pump at the determined frequency of the periodic pressurization when the at least one sensor indicates that the at least one operational condition of the engine is less than a preset operational condition of the engine.

42. The engine of claim 41, wherein the at least one sensor comprises a first sensor configured to detect the speed of the engine, the engine additionally comprising a second sensor configured to sense the load on the engine.

43. The engine of claim 41, wherein the at least one sensor comprises a first sensor configured to detect the speed of the engine or the load on the engine, the engine additionally comprising a second sensor configured to detect the temperature of the lubricant.

44. The engine of claim 41, wherein the at least one sensor comprises a first sensor configured to detect the speed of the engine or the load on the engine, the engine additionally comprising a second sensor configured to detect an actual flow of the lubricant.

45. The engine of claim 41, wherein the maximum period of time is a minimum amount of time required for the lubrication pump to complete one stroke.

* * * * *

UNITED STATES PATENT AND TRADEMARK OFFICE

CERTIFICATE OF CORRECTION

PATENT NO. : 7,150,249 B2
APPLICATION NO. : 10/439049
DATED : December 19, 2006
INVENTOR(S) : Masahiko Kato It is certified that error appears in the above-identified patent and that said Letters Patent is hereby corrected as shown below:

On sheet 8 of 15 (figure 8), at line 3 of reference numeral S17, please delete "KT" and insert -- $K_T$ --, therefore.

On sheet 11 of 15 (figure 11), at line 3 of reference numeral S28, please delete "KT" and insert -- $K_T$ --, therefore.

At column 5, line 58, please delete "thereof," and insert -- thereof; --, therefore.

At column 6, line 11, after "speed" please insert -- and --.

At column 6, line 13, after "versus" please insert -- the --.

At column 15, line 34, please delete "$T_{ON}$corresponding" and insert -- $T_{ON}$ corresponding --, therefore. (Consider space).

At column 18, line 42, please delete "$TO_N$11" and insert -- $T_{ON}$11 --, therefore.

At column 20, line 60, please delete "multiples" and insert -- multiplies --, therefore.

At column 21, line 42, please delete "lapsed." and insert -- elapsed. --, therefore.

At column 24, line 59, please delete "ihe" and insert -- the --, therefore.

UNITED STATES PATENT AND TRADEMARK OFFICE

CERTIFICATE OF CORRECTION

PATENT NO. : 7,150,249 B2
APPLICATION NO. : 10/439049
DATED : December 19, 2006
INVENTOR(S) : Masahiko Kato It is certified that error appears in the above-identified patent and that said Letters Patent is hereby corrected as shown below:

At column 26, line 63, please delete "reciuired" and insert -- required --, therefore.

Signed and Sealed this

Twenty-seventh Day of May, 2008

JON W. DUDAS
*Director of the United States Patent and Trademark Office*